US010257888B2

(12) United States Patent
Xie

(10) Patent No.: US 10,257,888 B2
(45) Date of Patent: Apr. 9, 2019

(54) ELECTRIC HEATING PAD FOR WATER HEATER

(71) Applicant: Zhelan Xie, Shenzhen (CN)

(72) Inventor: Zhelan Xie, Shenzhen (CN)

(73) Assignee: Shenzhen Genesis Lighting Co., Ltd., Shenzhen (CN)

( * ) Notice: Subject to any disclaimer, the term of this patent is extended or adjusted under 35 U.S.C. 154(b) by 794 days.

(21) Appl. No.: 14/433,459

(22) PCT Filed: Dec. 31, 2014

(86) PCT No.: PCT/CN2014/095959
§ 371 (c)(1),
(2) Date: Apr. 3, 2015

(87) PCT Pub. No.: WO2015/196777
PCT Pub. Date: Dec. 30, 2015

(65) Prior Publication Data

US 2016/0262210 A1 Sep. 8, 2016

(30) Foreign Application Priority Data

Jun. 25, 2014 (CN) ..... 2014 2 0344255 U
Jun. 26, 2014 (CN) ..... 2014 2 0347667 U
(Continued)

(51) Int. Cl.
*H05B 3/03* (2006.01)
*H05B 3/34* (2006.01)
(Continued)

(52) U.S. Cl.
CPC ..... *H05B 3/36* (2013.01); *F24H 1/0018* (2013.01); *H05B 1/0244* (2013.01); *H05B 3/145* (2013.01);
(Continued)

(58) Field of Classification Search
None
See application file for complete search history.

(56) References Cited

U.S. PATENT DOCUMENTS 3,500,014 A * 3/1970 Longo ..... H05B 3/342 219/211
3,808,403 A * 4/1974 Kanaya ..... B63C 11/28 219/212
(Continued)

FOREIGN PATENT DOCUMENTS

CN 202602933 U * 12/2012
CN 202940990 U 5/2013
JP 2002203663 A 7/2002

OTHER PUBLICATIONS

CN 202602933 U, "Multipurpose Heating Pad," Chen, Dec. 2012, Bib data page with Abstract, partial translation.*
(Continued)

*Primary Examiner* — Joseph M Pelham

(57) ABSTRACT

An electric heating pad for a water tank includes a substrate, a heating layer paved on the substrate, a leading wire that is electrically connected to the heating layer, and a fastener that fixes the leading wire. The substrate is configured with a first through hole that latching to the leading wire. The fastener includes a first fixed part and a second fixed part that are arranged on two faces of the substrate. The second fixed part is configured with a clamp part, and a second through hole matching to the leading wire is arranged at the clamp part. The fastener further includes a connecting rod that connects the first fixed part to the second fixed part, the substrate is configured with a third through hole, and the connecting rod passes through the third through hole to make the substrate be clamped between the first fixed part and the second fixed part.

6 Claims, 17 Drawing Sheets

(30) Foreign Application Priority Data

Jun. 26, 2014 (CN) ..... 2014 2 0348143 U
Jul. 4, 2014 (CN) ..... 2014 2 0372435 U
Oct. 22, 2014 (CN) ..... 2014 2 0614535 U

(51) Int. Cl.
*H05B 3/36* (2006.01)
*F24H 1/00* (2006.01)
*H05B 1/02* (2006.01)
*H05B 3/14* (2006.01)
*H05B 3/26* (2006.01)

(52) U.S. Cl.
CPC ..... *H05B 3/267* (2013.01); *H05B 2203/016* (2013.01)

(56) References Cited

U.S. PATENT DOCUMENTS 4,197,449 A * 4/1980 Fessenden ..... H05B 3/34 219/528
4,250,397 A * 2/1981 Gray ..... H05B 3/36 219/212
4,468,557 A * 8/1984 Bylin ..... H05B 3/36 174/51
8,253,071 B2 * 8/2012 Weiss ..... H05B 1/0238 219/202
2001/0025846 A1 * 10/2001 Kochman ..... H02H 5/043 219/545
2002/0106201 A1 * 8/2002 Tseng ..... B65D 81/3476 392/339
2003/0047548 A1 * 3/2003 Horey ..... H05B 3/342 219/212
2004/0217110 A1 * 11/2004 Gray ..... H05B 3/34 219/528
2008/0083721 A1 * 4/2008 Kaiserman ..... A43B 3/0005 219/211
2008/0116189 A1 * 5/2008 Fernandez ..... A41D 13/0051 219/211
2009/0057288 A1 * 3/2009 Chen ..... H05B 3/342 219/211
2009/0277671 A1 * 11/2009 Hahn ..... B32B 17/10036 174/257
2011/0186558 A1 * 8/2011 Campbell ..... H05B 3/34 219/201
2012/0298652 A1 * 11/2012 Winter ..... B64D 15/12 219/538
2013/0037531 A1 * 2/2013 Gray ..... A41D 13/0051 219/211
2013/0227757 A1 * 9/2013 Chen ..... A41D 13/0051 2/69
2013/0228562 A1 * 9/2013 Chen ..... H05B 3/34 219/211
2014/0166638 A1 * 6/2014 Irgens ..... H05B 3/34 219/528
2014/0183180 A1 * 7/2014 Watakabe ..... H05B 3/36 219/478
2015/0083705 A1 * 3/2015 Cronn ..... H05B 3/347 219/211
2015/0136753 A1 * 5/2015 Cronn ..... A41D 13/0051 219/211
2015/0208739 A1 * 7/2015 Taylor ..... A41D 13/0051 219/211
2015/0272236 A1 * 10/2015 Chen ..... A41D 13/0051 219/211
2015/0312965 A1 * 10/2015 Chen ..... H05B 3/34 219/211
2015/0382402 A1 * 12/2015 Chen ..... A41D 13/0051 219/211
2016/0262210 A1 * 9/2016 Xie ..... F24H 1/0018
2016/0278164 A1 * 9/2016 Iida ..... H05B 3/565
2017/0013889 A1 * 1/2017 Chen ..... A41D 13/0051

OTHER PUBLICATIONS

Xue Fei, the International Searching Authority written comments, Mar. 2015, CN.

* cited by examiner

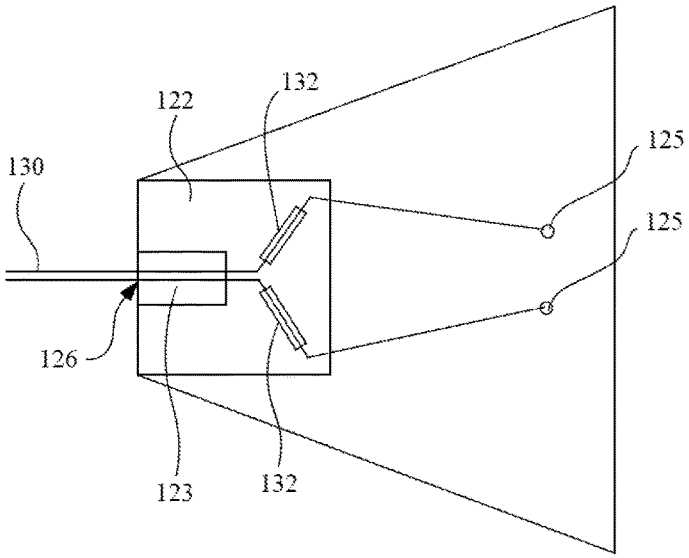
FIG. 32
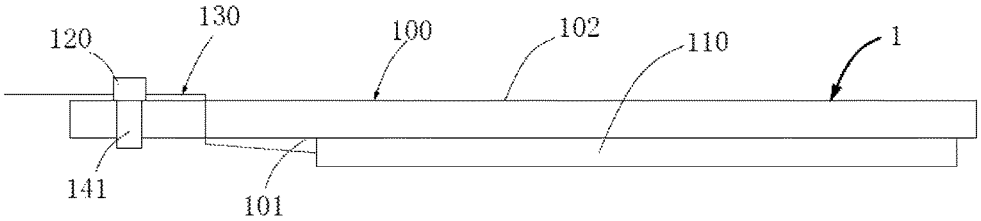
FIG. 33
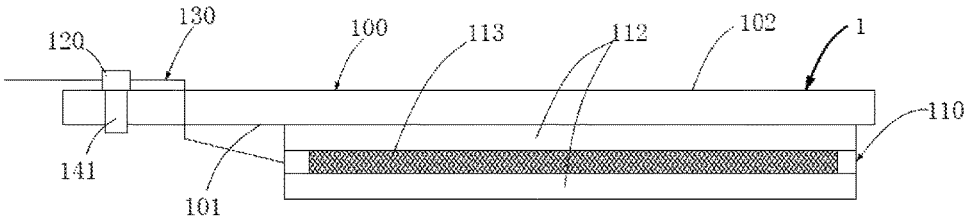

ELECTRIC HEATING PAD FOR WATER HEATER

TECHNICAL FIELD

The present disclosure relates to the field of an electric appliance, and more particularly to an electric heating pad for a water tank.

BACKGROUND

Winters are cold, and ice can easily form in water tanks of some cars, such as recreational vehicle (RVs). Thus, an electric heating pad is used to prevent ice formation around the water tank. The electric heating pad heats the water tank and prevents the water tank from ice formation after the electric heating is electrified. A typical electric heating pad includes a substrate, a heating layer, and a leading wire connected to the heating layer. The leading wire is directly soldered and fixed on the heating layer. The leading wire is easily separated from the heating layer after undue force acts on the leading wire during use of the electric heating pad, which causes the electric heating pad not to work.

SUMMARY

The aim of the present disclosure is to provide an electric heating pad for a water tank having close connection between a leading wire and a heating layer.

The aim of the present disclosure is achieved by the following methods

An electric heating pad for a water tank comprises a substrate, a heating layer paved on the substrate, a leading wire, and a fastener. The leading wire is electrically connected to the heating layer, and the substrate is configured with a first through hole that is matching to the leading wire. The leading wire is fixed by the fastener, and the fastener comprises a first fixed part and a second fixed part that are arranged on two faces of the substrate. The second fixed part is configured with a clamp part, and a second through hole matching to the leading wire is arranged at the clamp part. The fastener further comprises a connecting rod that connects the first fixed part to the second fixed part, the substrate is configured with a third through hole, and the connecting rod passes through the third through hole to make the substrate be clamped between the first fixed part and the second fixed part.

Furthermore, the second fixed part is configured with at least two clamp parts that extend along the leading wire, and the leading wire is clamped and fixed by at least two clamp parts together. The leading wire is clamped and fixed by at least clamp parts together, which increases fixed area of the leading wire, and makes the leading wire be firmly fixed.

Furthermore, the reinforcing material layer is arranged at one of faces of the substrate, the first fixed part is fixed on the face of the substrate having the reinforcing material layer, and is arranged to cling the reinforcing material layer. The reinforcing material layer enhances strength and tensile property of the first fixed part.

Furthermore, an adhesive layer is arranged at a surface of the heating layer, the protecting layer is arranged on the adhesive layer, and the protecting layer may be removed when the electric heating pad for the water tank is used. The adhesive layer arranged on the surface of the heating layer makes the first and second fixed parts be firmly fixed, and further makes the clamp part and the leading wire be firmly fixed. The protecting layer may protect the adhesive layer and the substrate when the electric heating pad for the water tank is not used.

An electric heating pad for a water tank comprises a substrate, a heating layer paved on the substrate, a leading wire, a reinforcing material layer fixed on the substrate, and a fastener fixed between the substrate and the reinforcing material layer. The leading wire is electrically connected to the heating layer, and the substrate is configured with a first through hole that is matching to the leading wire. The fastener is configured with a second through hole, the leading wire passes through the second through hole, and a site of the second through hole is corresponding to a site of the first through hole.

Furthermore, a through pipe is extended from the fastener along a direction of a side wall of the second through hole toward the substrate, the leading wire passes through the through pipe, and the through pipe is matching to the first through hole. The through pipe increases contact area of the fastener and the leading wire, makes the leading wire be firmly fixed, and shares more acting force acted on the leading wire, which reduces the acting force acted on the connection point between the leading wire and heating layer. In addition, the through pipe may prevent the acting force produced when pulling the leading wire from be directly acted on the side wall of the first through hole, and damage to the substrate is further avoided.

Furthermore, a height of the through pipe is less than or equal to a height of the first through hole, which avoids that the through pipe extrudes the substrate, and ensures the fastener to lie between the substrate and the reinforcing material layer.

Furthermore, a chamfer is arranged at two ends of an inner wall of the second through hole. A number of the second through hole is two, a number of the leading wire is two, and the two leading wires are matching to the two second through hole, respectively.

Furthermore, the fastener is made of plastic material or metal material. The plastic material has good strength and elasticity, thus, the leading wire is firmly fixed by the fastener. Surface of the plastic material is smooth, and has small frictional force, which avoids damage to the leading wire when the leading wire is pulled. The metal material has great strength and may be firmly fixed, thus, the leading wire is firmly fixed by the fastener made of metal material. Surface of the metal material is smooth, and has small frictional force, which avoids damage to the leading wire when the leading wire is used.

Furthermore, a groove is arranged at the fastener, and the leading wire is fixed in the groove. The groove is connected to the second through hole, a placing slot is arranged between the substrate and the reinforcing material layer, and the fastener is arranged in the placing slot. The groove limits the leading wire, and makes the leading wire easily pass through the second through hole. The groove increases a contact area of the fastener and the leading wire, thus, the leading wire is firmly fixed. The placing slot limits the fastener, and makes the fastener be firmly fixed, thus, the leading wire may be firmly fixed by the fastener.

An electric heating pad for a water tank comprises a substrate, a heating layer paved on the substrate, a leading wire, and a fastener. The leading wire is electrically connected to the heating layer. The leading wire is fixed by the fastener, and the fastener comprises a first fixed part and a second fixed part that are arranged on two faces of the substrate. The second fixed part is configured with a clamp part, an open-slot is arranged at the clamp part, the leading wire is clamped into the clamp part through the open-slot, and a width of the open-slot is less than a diameter of the leading wire.

Furthermore, the open-slot is arranged at a side face of the clamp part, which makes the leading wire be easily clamped into the clamp part. Compared with arranging the leading wire in the clamp part through end-ports of the clamp part at two ends thereof, arranging the leading wire in the clamp part through the open-slot is easier and faster, and time of producing the electric heating pad for the water tank is shortened. The leading wire is clamped and fixed by the clamp part, which avoids removing of the leading wire from the clamp part.

Furthermore, the second fixed part is configured with at least two clamp parts that extend along the leading wire, and the leading wire is clamped and fixed by at least two clamp parts together. The leading wire is clamped and fixed by at least clamp parts together, which increases fixed area of the leading wire, and makes the leading wire be firmly fixed.

Furthermore, a reinforcing material layer is arranged at one of faces of the substrate, and the first fixed part is fixed on the face of the substrate having the reinforcing material layer; area of the reinforcing material layer is greater than contact area of the first fixed part and the reinforcing material layer. The reinforcing, material layer enhances strength and tensile property of the first fixed part.

Furthermore, an adhesive layer is arranged at a surface of the heating layer, the protecting layer is arranged on the adhesive layer, and the protecting layer may be removed when the electric heating pad for the water tank is used. The adhesive layer arranged on the surface of the heating layer makes the first and second fixed parts be firmly fixed, and further makes the clamp part and the leading wire be firmly fixed. The protecting layer may protect the adhesive layer and the substrate when the electric heating pad for the water tank is not used.

An electric heating pad for a water tank comprises a substrate, a heating layer paved on the substrate, a leading wire, and a fastener sleeved and fixed on one end of the substrate. The leading wire is electrically connected to the heating layer. A clamp part is arranged at the fastener, and the leading wire is clamped and fixed by the clamp part.

Furthermore, an end portion of the substrate tapers to form conical contour, the fastener is matching to the end portion of the substrate, which makes the fastener be firmly fixed on the substrate.

Furthermore, the fastener is configured with at least two clamp parts that extend along the leading wire, and the leading wire is clamped and fixed by at least two clamp parts together. The leading wire is clamped and fixed by at least clamp parts together, which increases fixed area of the leading wire, and makes the leading wire be firmly fixed.

Furthermore, the fastener is made of plastic material or metal material. An adhesive layer is arranged at a surface of the heating layer, and a protecting layer is arranged on the adhesive layer to protect the adhesive layer, the protecting layer may be removed when the electric heating pad for the water tank is used. The adhesive layer arranged on the surface of the heating layer makes the first and second fixed parts be firmly fixed, and further makes the clamp part and the leading wire be firmly fixed. The protecting layer may protect the adhesive layer and the substrate when the electric heating pad for the water tank is not used.

An electric heating pad for a water tank comprises a substrate comprising a first face and a second face, a heating layer paved on the first face of the substrate, a leading wire, and a fastener. The leading wire is electrically connected to the heating layer, and a connection point is formed between the leading wire and the heating layer. The substrate is configured with a first through hole that is matching to the leading wire, and the leading wire passes through the second face of the substrate. The fastener comprises a first fixed part arranged on the first face of the substrate and a second fixed part arranged on the second face of the substrate. The first fixed part is in direct contact with the connection point, and the connection point is fully covered by the first fixed part. A clamp part is arranged at the second fixed part, a second through hole is arranged at the clamp part, and the second through hole is matching to the leading wire. The fastener further comprises a connecting rod, and the connecting rod connects and fixes the first fixed part to the second fixed part.

Furthermore, a third through hole is arranged at the substrate, and the connecting rod passes through the third through hole to clamp the substrate between the first fixed part and the second fixed part, which makes the substrate be tightly clamped for a long time, and the substrate is firmly arranged.

Furthermore, the first fixed part, the second fixed part, and the connecting rod are integrally formed in a single piece, which simplifies producing process of the fastener, and the fastener is easily installed to the substrate.

Furthermore, a protruding portion is arranged on the second fixed part. The protruding portion is arranged between the first through hole and the clamp part, and height of the protruding portion is greater than height of the clamp part. The leading wire from the second face of the substrate goes along a top portion of the protruding portion, and passes through the clamp part via the second through hole. Thus, when the leading wire s used, acting point is acted on the clamp part because an angle exists before the leading wire passes through the second through hole, the acting force does not directly act on the connection point between the leading wire and the heating layer, and the service life of the electric heating pad for the water tank is prolonged.

Furthermore, a clamping slot is arranged at the second fixed part, and the clamping slot is arranged between the first through hole and the clamp part. An extending direction of the clamping slot and an extending direction of the second through hole cross each other, the leading wire is inserted into the clamping slot, and then passes through the clamp part via the second through hole. The leading wire is bent many times when the leading wire passes through the clamp part, thus, stressed points of the leading wire are dispersed, and the acting force produced during pulling the leading wire is not directly acted on the connection point between the leading wire and the heating layer, thereby avoiding damage to the electric heating pad.

An electric heating pad for a water tank comprises a substrate comprising a first face and a second face, a heating layer paved on the first face of the substrate, a leading wire, and a fastener arranged at the second face of the substrate. The leading wire is electrically connected to the heating layer, and the leading wire passes through the second face of the substrate. Fixed pins are connected to two ends of the fastener, and a leading wire exposed to the second face of the substrate passes between the fastener and the second face of the substrate; the fastener is connected to a first end of the fixed pin, and a second end of the fixed pin passes through the substrate and be tightened with the first face of the substrate.

Furthermore, a bending portion is formed at the second end of the fixed pin, and the bending portion and the first face of the substrate are fixed by bonding. As long as the length of the fixed pin is greater than the thickness of the substrate, length of the bending portion may be adjusted according to the thickness of the substrate, structure is simple, cost is low, and generality is good.

Furthermore, a reinforced sheet made of hard material is fixed on the first face of the substrate, and the second end of the fixed pin is in fixed connection with the reinforced sheet. Contact area of the reinforced sheet and the substrate is great, and the fixed pin is in fixed connection with the reinforced sheet, which improves connection strength of the fastener and the substrate.

Furthermore, the fastener and the fixed pin are integrally formed in a single piece, and at least two fixed pins are arranged at one end of the fastener. The number of the fixed pin is increased, which further improves resistance to stress of the fastener.

Furthermore, distance between the fixed pins arranged two ends of the fastener is same as a width of the fastener.

Furthermore, the heating layer comprises two heat-conducting layers that are made of insulative material, a carbon fiber layer is arranged between the two heat-conducting layers. The carbon fiber layer comprises a plurality of carbon fiber filaments, two adjacent carbon fiber filaments are parallel to each other, and each of the carbon fiber filaments is arranged in a curve.

In the present disclosure, the electric heating pad is configured with the clamp part, and the leading wire matching to the second through hole is arranged at the clamp part. When the electric heating pad is used, an acting force produced during pulling the leading wire is acted on the clamp part, the leading wire stuck in the clamp part is firmly fixed because the clamp part is fixed at the second fixed part, which prevents disconnection between the leading wire and the heating layer when the leading wire is used, and reduces an acting force produced at a connection point between the leading wire and the heating layer. Thus, the connection point is not easy to fall off, and service life of the electric heating pad for the water tank is improved. The clamp part is fixed on the second fixed part, which is good for the clamp part to make the leading wire be firmly stuck in the clamp part, and avoids move of the leading wire. The first fixed part and the second fixed part are arranged at the substrate of the electric heating pad, and the connecting rod is arranged between the first fixed part and the second fixed part, the connecting rod passes through the third through hole of the substrate to make the substrate be firmly clamped between the first fixed part and the second fixed part, thereby improving stretching resistance and mechanical strength of the electric heating pad.

BRIEF DESCRIPTION OF FIGURES

FIG. 32 is a top view of the electric heating pad for the water tank of the nineteenth example of the present disclosure.

FIG. 33 is a structural diagram of an electric heating pad for a water tank of a twentieth example of the present disclosure.

FIG. 34 is a lateral view of the electric heating pad for the water tank of the twentieth example of the present disclosure.

DETAILED DESCRIPTION

The present disclosure will further be described in detail in accordance with the figures and the exemplary examples.

EXAMPLE 1

Figure 1:
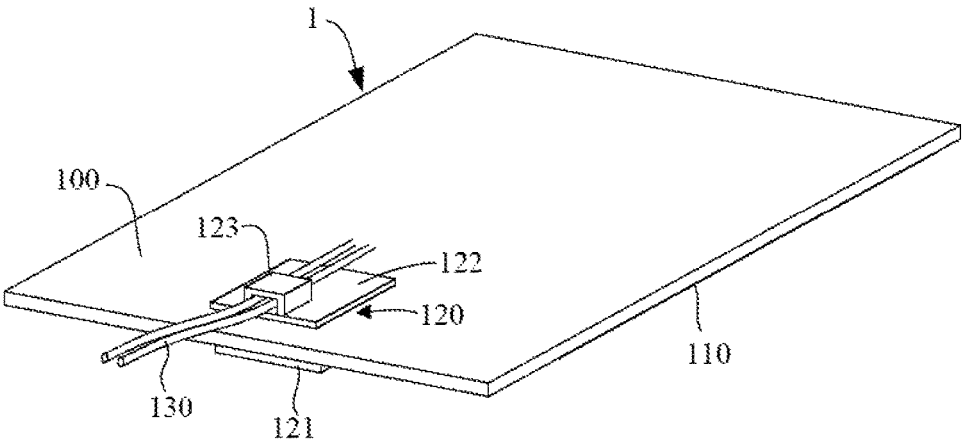
FIG. 1 is a stereogram of an electric heating pad for a water tank of a first example of the present disclosure.
Figure 2:
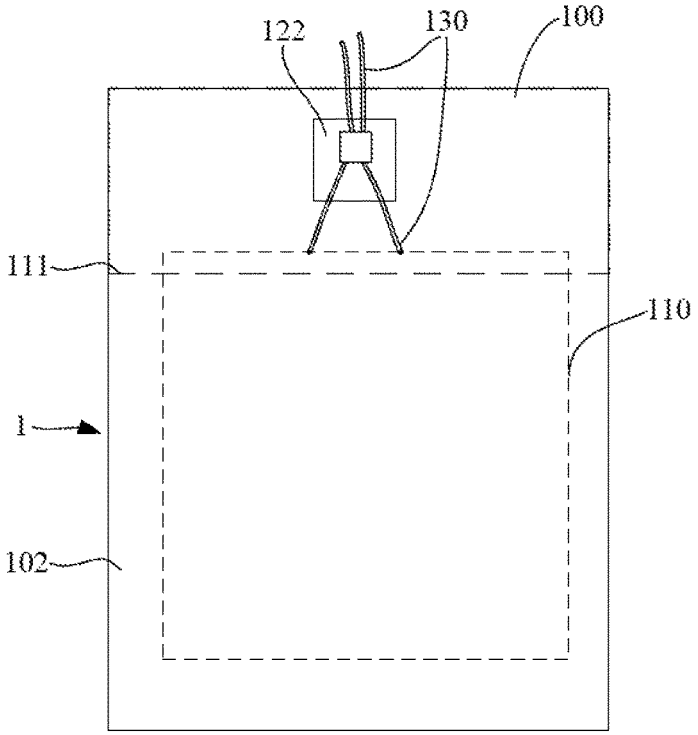
FIG. 2 is a top view of the electric heating pad for the water tank of the first example of the present disclosure.
Figure 3:
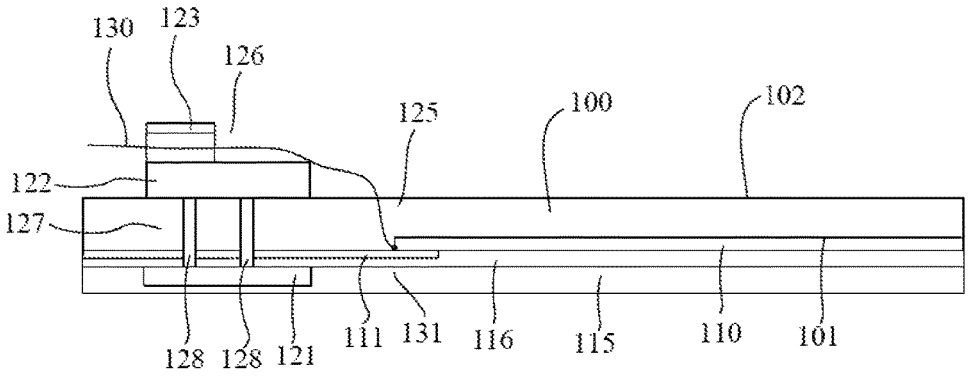
FIG. 3 is a sectional view of the electric heating pad for the water tank of the first example of the present disclosure.

An shown in FIG. 1-FIG. 3, in a first example of the present disclosure, an electric heating pad 1 for a water tank comprises a substrate 100 comprising a first face 101 and a second face 102, a heating layer 110 paved on the first face 101 of the substrate 100, and a leading wire 130, where the leading wire 130 is electrically connected to the heating layer 110, and the substrate 100 is configured with a first through hole 125 matching to the leading wire 130.

The electric heating pad 1 for the water tank further comprises a fastener 120 that fixes the leading wire 130, and the fastener 120 comprises a first fixed part 121 and a second fixed part 122 that are arranged on the substrate 100, where the first fixed part 121 is arranged on the first face 101 of the substrate 100, and the second fixed part 122 is arranged on the second face 102 of the substrate 100. The second fixed part 122 is configured with a clamp part 123, and a second through hole 126 matching to the leading wire 130 is arranged at the clamp part 123. The fastener 120 further comprises a connecting rod 128 that connects the first fixed part 121 to the second fixed part 122. The substrate 100 is configured with a third through hole 127, and the connecting rod 128 passes through the third through hole 127 to make the substrate 100 be clamped between the first fixed part 121 and the second fixed part 122. In the present disclosure, the electric heating pad is configured with the clamp part 123, and the leading wire 130 matching to the second through hole 126 is arranged at the clamp part 123. When an acting force produced during pulling the leading wire 130 is acted on the clamp part 123, the leading wire 130 stuck in the clamp part 123 is firmly fixed because the clamp part 123 is fixed at the second fixed part 122, which prevents disconnection between the leading wire 130 and the heating layer 110 when the leading wire 130 is pulled, and reduces an acting force produced at a connection point between the leading wire 130 and the heating layer 110. Thus, the connection point is not easy to fall off, and service life of the electric heating pad 1 for the water tank is improved. The clamp part 123 is fixed on the second fixed part 122, which is good for the clamp part 123 to make the leading wire 130 be firmly stuck in the clamp part 123, and avoids move of the leading wire 130. The first fixed part 121 and the second fixed part 122 are arranged at the substrate 100 of the electric heating pad for the water tank, and the connecting rod 128 is arranged between the first fixed part 121 and the second fixed part 122, where the connecting rod 128 passes through the third through hole 127 of the substrate 100 to make the substrate 100 be firmly clamped between first fixed part 121 and the second fixed part 122, thereby improving stretching resistance and mechanical strength of the electric heating pad for the water tank.

As shown in FIG. 3, the connection point 131 is formed between the leading wire 130 and the heating layer 110. In the example, a reinforcing material layer 111 is arranged at the substrate 100, where the reinforcing material layer 111 is arranged at a side of the first fixed part 121 and the reinforcing material layer 111 is stuck on the substrate 100. The first fixed part 121 is fixed on the reinforcing material layer 111, where part of heating layer 110 is covered by the reinforcing material layer 111, especially the connection point 131 between the heating layer 110 and the leading wire 130 is covered by the reinforcing material layer 111. The reinforcing material layer 111 is stuck on the substrate 100 through a glue, thus, the reinforcing material layer 111 reinforces the connection point 131 between the heating layer 110 and the leading wire 130, and makes the leading wire 130 firmly connect to the heating layer 110, thereby improving the service life of the electric heating pad for the water tank.

An adhesive layer 116 is arranged on a surface of the heating layer 110, the reinforcing material layer 111 is covered by the adhesive layer 116, and the fixed part 121 is fixed on the adhesive layer 116, which reinforces the fastener 120. The electric heating pad for the water tank is further configured with a protecting layer 115 that protects the adhesive layer 116 and can be removed when the electric heating pad for the water tank is used, and the adhesive layer 116 is fully covered by the protecting layer 115. When the electric heating pad for the water tank is used, the protecting layer 115 is removed, and the electric heating pad for the water tank is pasted on the water tank though the adhesive layer 116. The water tank can be heated when power turns on. Thus, the adhesive layer 116 and the protecting layer 115 improve facilitating function of use of the electric heating pad for the water tank.

In the example, the substrate 100 is made of foam material, where the foam material has good thermal insulation effect. It should be understood that other materials having thermal insulation effect may be used. The reinforcing material layer is made of stiffening fibre material, which increases strength of the electric heating pad for the water tank. It should be understood that the reinforcing material layer may be made of other materials.

In the example, the electric heating pad for the water tank can be used for a water tube of a car or the water tank of the car, and heats up them to avoid icing formation.

In the example, when the leading wire is pulled, the fastener 120 limiting and fixing the leading wire 130 can endure greater acting force, and the electric heating pad for the water tank is not damaged.

In the example, the fastener 120 may be arranged at an edge of the substrate 100, and may also be arranged at a middle position of the substrate 100. As shown in FIG. 2 and FIG. 3, the first fixed part 121 and the second fixed part 122 are not arranged at the edge of the substrate 100.

EXAMPLE 2

Figure 4:
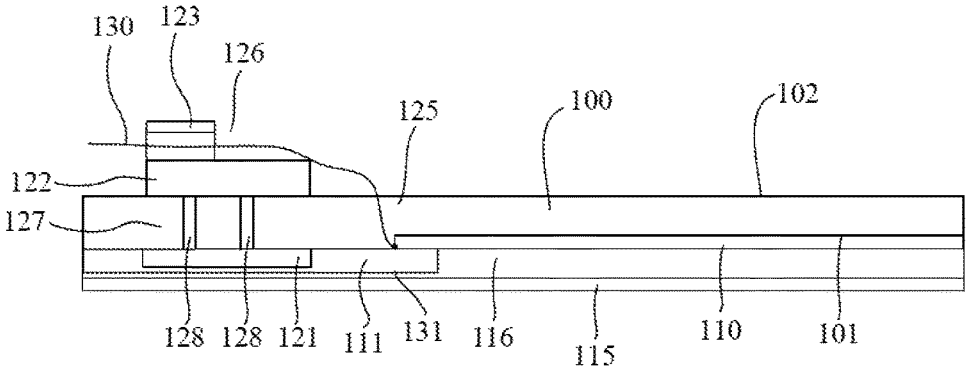
FIG. 4 is a sectional view of an electric heating pad for a water tank of a second example of the present disclosure.

As shown in FIG. 4, in a second example, differences between the second example and the first example lie in that, the first fixed part 121 is fixed on the substrate 100, the reinforcing material layer 111 is fixed on the first fixed part 121, the first fixed part 121 and the heating layer 110 are covered by the adhesive layer 116, and the adhesive layer 116 is fully covered by the protecting layer 115, where the part of heating layer 110 is covered by the reinforcing material layer 111, especially the connection point 131 between the heating layer 110 and the leading wire 130 is covered by the reinforcing material layer 111.

EXAMPLE 3

Figure 5:
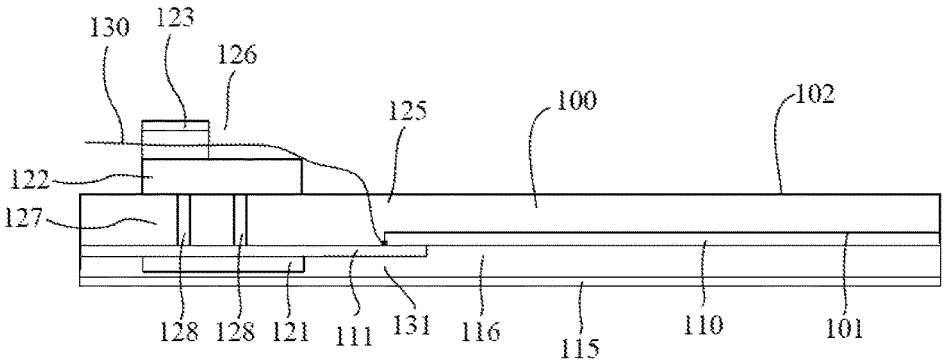
FIG. 5 is a sectional view of an electric heating pad for a water tank of a third example of the present disclosure.

As shown in FIG. 5, in a third example, differences between the third example and the first example lie in that, the reinforcing material layer 111 is fixed on the substrate 100, the first fixed part 121 is fixed on the reinforcing material layer 111, the first fixed part 121 and the heating layer 110 are covered by the adhesive layer 116, and the adhesive layer 116 is fully covered by the protecting layer 115, where the part of heating layer 110 is covered by the reinforcing material layer 111, especially the connection point 131 between the heating layer 110 and the leading wire 130 is covered by the reinforcing material layer 111.

However, the part of heating layer 110 is covered by the reinforcing material layer 111, and the connection point 131 between the heating layer 110 and the leading wire 130 is covered by the reinforcing material layer 111.

EXAMPLE 4

Figure 6:
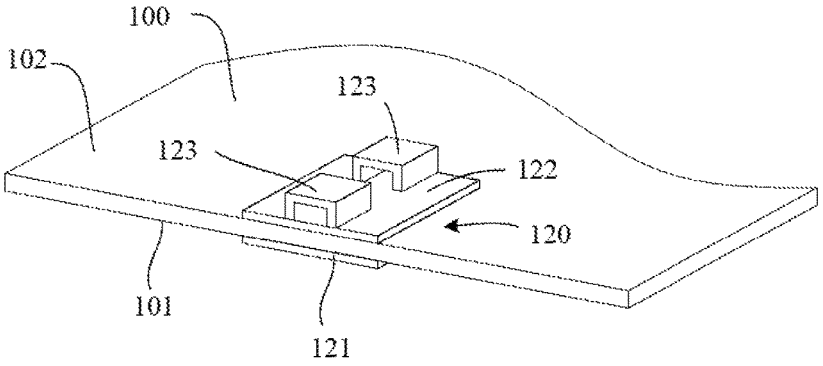
FIG. 6 is a stereogram of an electric heating pad for a water tank of a fourth example of the present disclosure.
Figure 7:
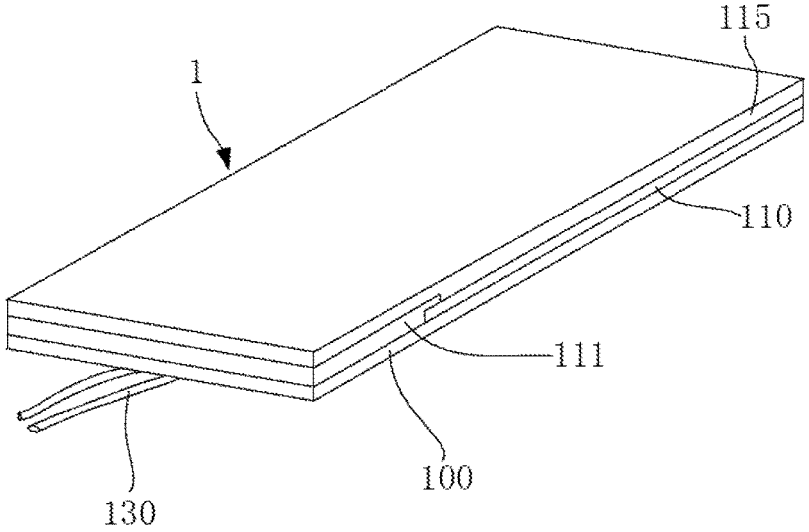
FIG. 7 is a stereogram of an electric heating pad for a water tank of a fifth example of the present disclosure.
Figure 8:
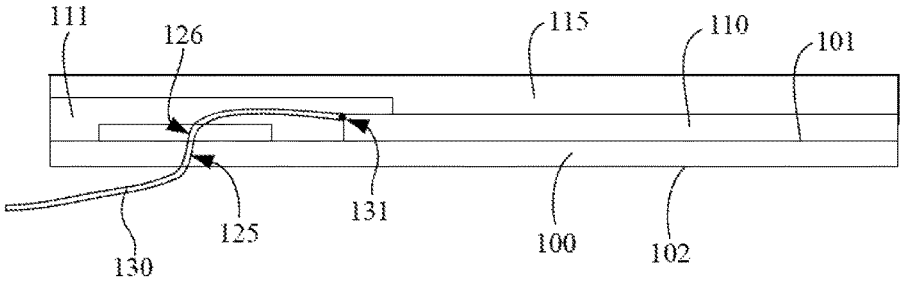
FIG. 8 is a sectional view of the electric heating pad for the water tank of the fifth example of the present disclosure.
Figure 9:
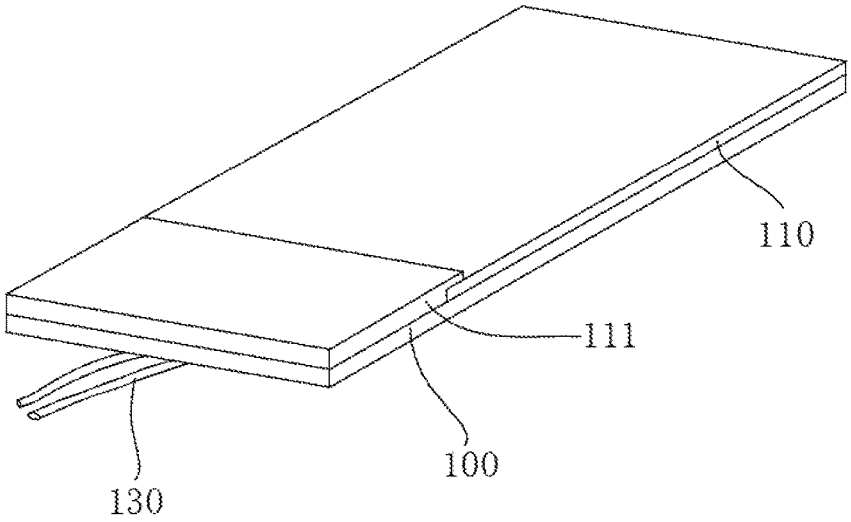
FIG. 9 is a structural diagram of the electric heating pad for the water tank without the protect layer of the fifth example of the present disclosure.
Figure 10:
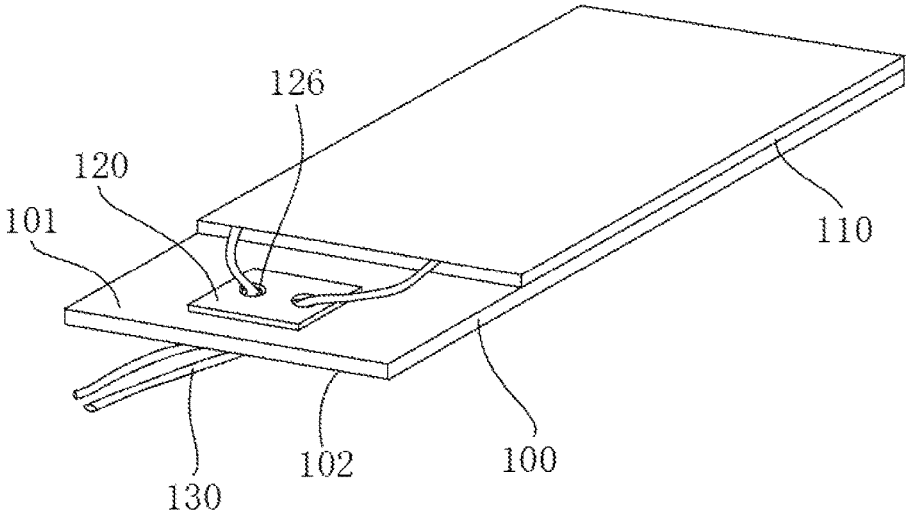
FIG. 10 is a coordinate diagram of a heating layer, a fastener, a leading wire, and a substrate of the fifth example of the present disclosure.
Figure 11:
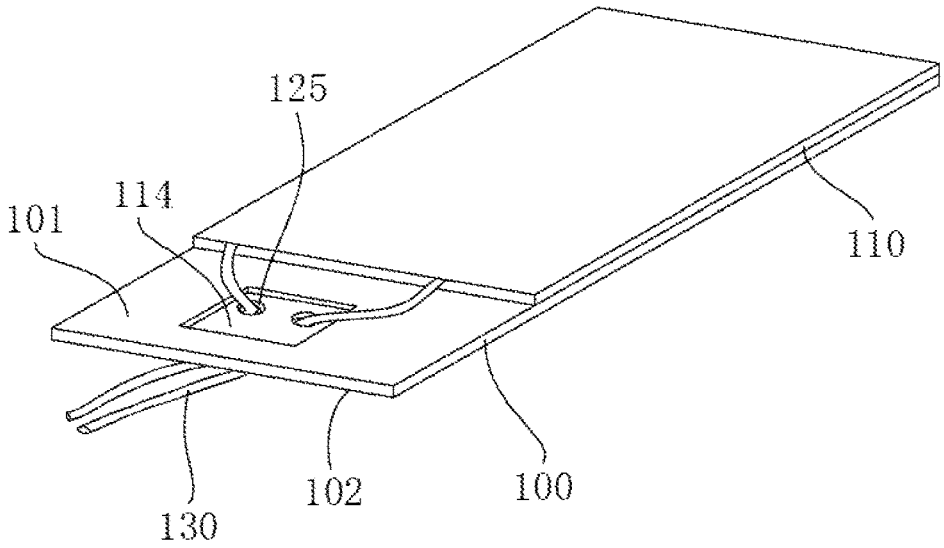
FIG. 11 is a coordinate diagram of the leading wire and the substrate of the fifth example of the present disclosure.

As shown in FIG. 6, in a fourth example, differences between the fourth and first example lie that, the second fixed part 122 is configured with two clamp parts 123 that extend along the leading wire 130. The leading wire 130 is clamped and fixed by the two clamp parts 123 together, which increases a fixed area of the leading wire 130, and makes the leading wire 130 be firmly fixed. It should be understood that, in the example, a number of the clamp part may be three, four, or other. The leading wire is clamped and fixed by a plurality of clamp parts together, which increases the fixed area of the leading wire, and makes the leading wire be firmly fixed.

EXAMPLE 5

An shown in FIG. 7-FIG. 12, in a fifth example of the present disclosure, the electric heating pad 1 for the water tank comprises the substrate 100 comprising the first face 101 and the second face 102, the heating layer 110 paved on the first face 101 of the substrate 100, and the leading wire 130, where the leading wire 130 is electrically connected to the heating layer 110, and the substrate 100 is configured with the first through hole 125 matching to leading wire 130.

The electric heating pad for the water tank further comprises the reinforcing material layer 111 fixed on the substrate 100, and the fastener 120 fixed between the substrate 100 and the reinforcing material layer 111, where the fastener 120 is fixed on the first face 101 of the substrate 100. The fastener 120 is configured with the second through hole 126, where the leading wire 130 passes through the second through hole 126, and a site of the second through hole 126 is corresponding to a site of the first through hole 125.

In the present disclosure, the fastener 120 and the reinforcing material layer 111 are arranged at the electric heating pad for the water tank, where the reinforcing, material layer 111 is fixed on the substrate 100, and the fastener 120 is fixed between the substrate 100 and the reinforcing material layer 111, which makes the fastener 120 be firmly fixed. The fastener 120 is configured with the second through hole 126, and the substrate 100 is configured with the first through hole 125, and the leading wire 130 passes through the second through hole 126, the first through hole 125, and the second thee 102 of the substrate 100 in sequence when the leading wire 130 is electrically connected to the heating layer 110. In the present disclosure, the fastener 120 and the second through hole 126 limit the leading wire 130, thus, the acting force produced during pulling the leading wire 130 acted on the fastener 120. And the fastener 120 is firmly fixed between the substrate 100 and the reinforcing material layer 111, thus, the acting force produced during pulling the leading wire 130 cannot be acted on the connection point between the leading wire 130 and the heating layer 110, and disconnection between the leading wire 130 and the heating layer 110 is avoided, thereby firmly fixing the leading wire 130 on the electric heating pad for the water tank. In addition, the second through hole 126 limits the leading wire in all directions, thus, the fastener 120 can limit the leading wire 130 when the leading wire 130 is pulled from any direction around the second through hole 126. The leading wire 130 passes through a first surface of the fastener 120, the second through hole 126, and a second surface of the fastener 120 in sequence. And the fastener 120 also limit the leading wire 130 when the leading wire 130 is pulled from a direction perpendicular to the fastener 120, thus, the fastener 120 makes the leading wire 130 be more firmly fixed on the electric heating pad for the water tank.

In the example, a number of the second through hole 126 is two, a number of the leading wire 130 is two, and the two leading wires are matching to the two second through holes, which is one matching method of the leading wire 130 and the second through hole 126. The two leading wire 130 pass through the two through holes 126, respectively, and a diameter of the leading wire 130 is corresponding to a diameter of the second through hole 126, which makes side walls around the second through hole 126 limit the leading wire 130, thereby improving limit effect. When the leading wire 130 is pulled, resistance to the leading wire 130 produced by the side walls around the second through hole 126 largely reduces the acting force produced at the connection point between the leading wire 130 and the heating layer 110, thereby avoiding disconnection between the leading wire 130 and the heating layer 110. And the two second through holes of the fastener 120 are matching to the two leading wires 130, which avoids damage to the substrate 100 from the leading wire 130 during pulling the leading wire 130.

In the example, the fastener 120 is made of plastic material, and the fastener 120 is stuck and fixed between the substrate 100 and the reinforcing material layer 111 through the glue. The glue has good adhesive force for the plastic material, and makes the fastener 120 be firmly fixed, thus, the leading wire 130 can be firmly fixed by the fastener 120. The fastener 120 made of the plastic material has good strength and elasticity, thus, the leading wire 130 is firmly fixed by the fastener 120. Surfaces of the fastener 120 are smooth, and have small frictional force, which avoids damage to the leading wire 120 when the leading wire 130 is pulled. It should be understood that the fastener 120 may be made of other materials, e.g. metal material. The metal material has good strength, and makes the leading wire be firmly fixed.

In the example, chamfers are arranged at two ends of an inner wall of the second through hole 126, respectively. The chamfer avoids damage to the leading wire 130 from an edge angle of side wall around the second through hole 126. It should be understood that the chamfer may not be arranged.

Figure 12:
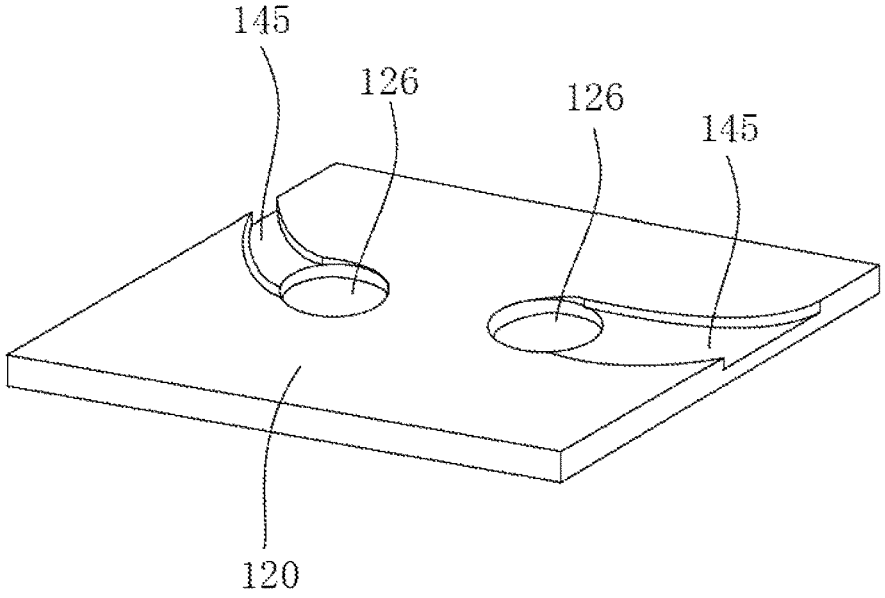
FIG. 12 is a structural diagram of a fastener of the fifth example of the present disclosure.

As shown in FIG. 12, in the example, a groove 145 is arranged at the fastener 120, and the leading wire 130 is fixed in the groove 145. The groove is connected to the second through hole 126, the groove 145 limits the leading wire 130, and makes the leading wire 130 easily pass through the second through hole 126. The groove 145 increases a contact area of the fastener 120 and the leading wire 130, thus, the leading wire 130 is firmly fixed. It should be understood that the groove may not be arranged.

In the example, a placing slot 114 is arranged between the substrate 100 and the reinforcing material layer 111, and the fastener 120 is arranged in the placing slot 114. The placing slot may also be arranged on one of the substrate 100 and the reinforcing material layer 111. The placing slot 114 limits the fastener 120, and makes the fastener 120 be firmly fixed, thus, the leading wire 130 may be firmly fixed by the fastener 120. It should be understood that the placing slot may not be arranged.

In the example, the fastener 120 is cuboid, namely a cross-section of the fastener 120 is rectangular. It should be understood that the fastener 120 may also be other structures, e.g. cylinder and triangular prism.

The heating layer 110, the fastener 120, and the reinforcing material layer 111 are fixed at the same face of the substrate 100. The heating layer 110 is covered by part of reinforcing material layer 111, and the part of reinforcing material layer 111 is fixed through the glue, which makes the leading wire 130 be limited and fixed, thus, the leading wire 130 is firmly fixed. In the example, the reinforcing material layer 111 and the heating layer 110 are fixed at the substrate 100 through the glue, it should be understood that other ways may be used for fixing the reinforcing material layer 111 and the heating layer 110. The structure of the electric heating pad for the water tank of the example is as follow: the first face 101 of the substrate 100 is coated with the glue, a first end of the first face 101 of the substrate 100 is covered by the heating layer 110, the fastener 120 is stuck and fixed on a second end of the first face 101 of the substrate 100, where a face of the fastener 120 opposite to the first face 101 of the substrate 100 is coated with the glue, and the second through hole 126 of the fastener 120 is matching to the first through hole 125 of the substrate 100. The reinforcing material layer 111 is stuck on the second end of the substrate 100 through the glue, the fastener 120 and part of the heating layer 110 are covered by the reinforcing material layer 111. The connection point 131 is formed between the leading wire 130 and the heating layer 110, and is covered by the reinforcing material layer 111, which makes the connection point 131 be firmly fixed. The protecting layer 115 is arranged on the heating layer 110 after the heating layer 110 is covered by the reinforcing material layer 111. In addition, an outer surface of the reinforcing material layer 111 is coated with the glue, and the reinforcing material layer 111 is covered by the protecting layer 115, thus, the electric heating pad for the water tank is easily used. The above-mentioned structure is one structure of the electric heating pad for the water tank, it should be understood that other structures may be used.

In the example, the reinforcing material layer 111 may not be arranged, and the fastener is directly fixed on the substrate. It should be understood that a plurality of reinforcing material layers may be arranged for improving the strength of the electric heating pad for the water tank.

In the example, the substrate 100 is made of foam material, where the foam material has good thermal insulation effect. It should be understood that other materials having thermal insulation effect may be used. The reinforcing material layer is made of stiffening fibre material, which increases strength of the electric heating pad for the water tank. It should be understood that the reinforcing material layer may be made of other materials.

In the example, the electric heating pad for the water tank can be used for the water tube of the car or the water tank of the car, and heats up them to avoid icing formation.

In the example, when the leading wire is pulled, the fastener 120 limiting and fixing the leading wire 130 can endure greater acting force, and the electric heating pad for the water tank is not damaged.

EXAMPLE 6

Figure 13:
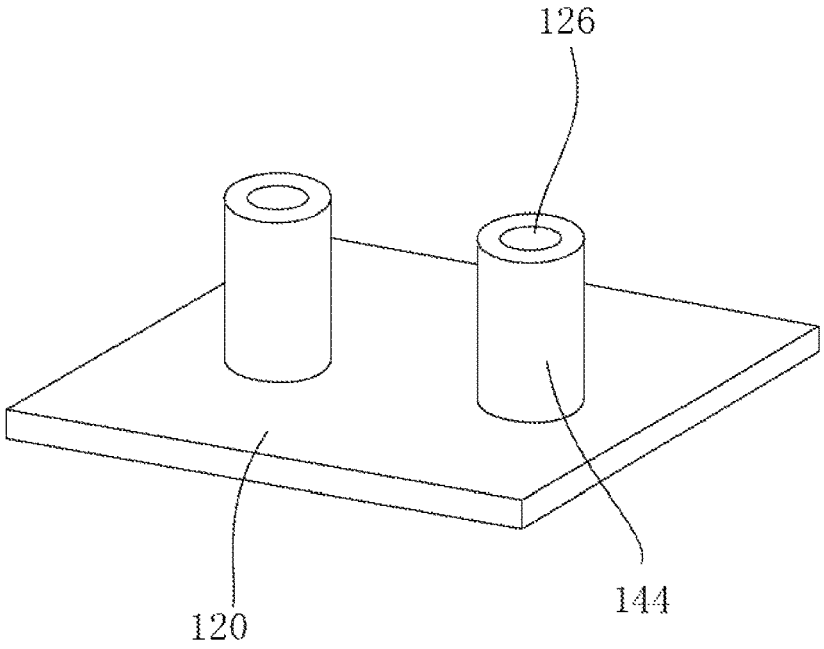
FIG. 13 is a structural diagram of a fastener of a sixth example of the present disclosure.

As shown in FIG. 13, in a sixth example, difference between the sixth and fifth example lie in that, a through pipe 144 is extended from the fastener 120 along a direction of the side wall of the second through hole 126 toward the substrate 100, the leading wire 130 passes through the through pipe 144, and the through pipe 144 is matching to the first through hole 125. The through pipe 144 is extended from the fastener 120 along the side wall the second through hole 126, and an inner side wall of the through pipe 144 is connected to the inner side wall of the second through hole 126, which increases the contact area of the fastener 120 and the leading wire 130, and the inner side walls of the second through hole 126 and the through pipe 144 limit the leading wire 130, thus, the leading wire is firmly fixed. Compared with limit of only the second through hole 126 to the leading wire 130, the limits of the second through hole 126 and the through pipe 144 to the leading wire 130 increase the resistance to the leading wire 130 when the leading wire 130 is pulled, thus, the leading wire 130 is firmly fixed at the electric heating pad for the water tank. In addition, the through pipe 144 is matching to the first through hole 125 of the substrate 100, the acting force produced when pulling the leading wire 130 is directly acted on the side wall of the first through hole 125, thereby avoiding damage to the substrate 100.

In the example, a height of the through pipe 144 is less than or equal to a height of the first through hole 125, which avoids that the through pipe 144 extrudes the substrate 100, and ensures the fastener 120 to lie between the substrate 100 and the reinforcing material layer 111. The height of the through pipe 144 is in a range of 2.7-3.0 mm, and experiment proves that the through pipe 144 of 2.7-3.0 mm not only makes the leading wire 130 be firmly fixed, but also better protects the substrate 100.

In the example, the chamfer is arranged at an edge of the side wall of the through pipe 144 to avoid damage to the leading wire 130 from the edge of the side wall of the through pipe 144. It should be understood that the chamfer may not be arranged.

EXAMPLE 7

Figure 14:
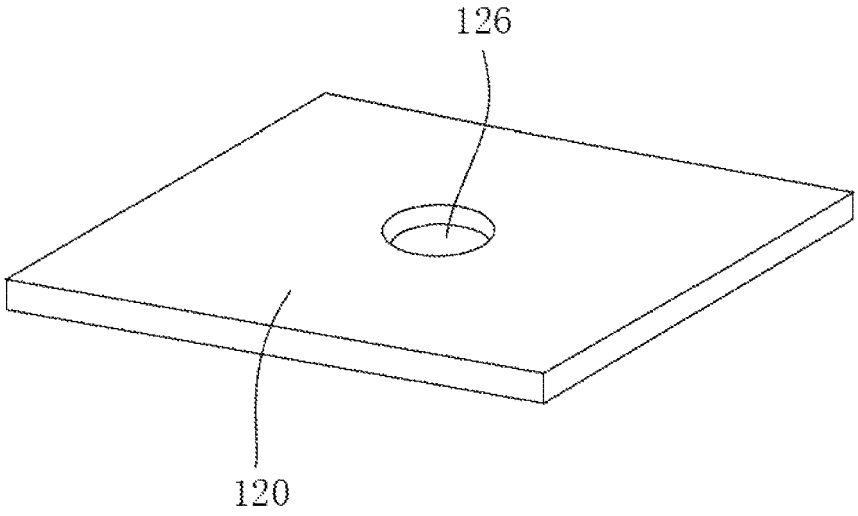
FIG. 14 is a structural diagram of a fastener of a seventh example of the present disclosure.

As shown in FIG. 14, in a seventh example, differences between the seventh and the fifth example lie in that, the number of the second through hole 126 is one, and the two leading wires pass through the second through hole 126, which is another matching method of the leading wire 130 and the second through hole 126. The two leading wire 130 pass through the one second through holes 126, the one second through hole 126 is arranged to match the two leading wires 130, and the side walls around the second through hole 126 limit the leading wire 130. When the leading wire 130 is pulled, resistance to the leading wire 130 produced by the side walls around the second through hole 126 largely reduces the acting force produced at the connection point between the leading wire 130 and the heating layer 110, thereby avoiding disconnection between the leading wire and the heating layer. And the second through hole of the fastener is matching to the two leading wires, which avoids damage to the substrate from the leading wire 130 during pulling the leading wire 130.

EXAMPLE 8

Figure 15:
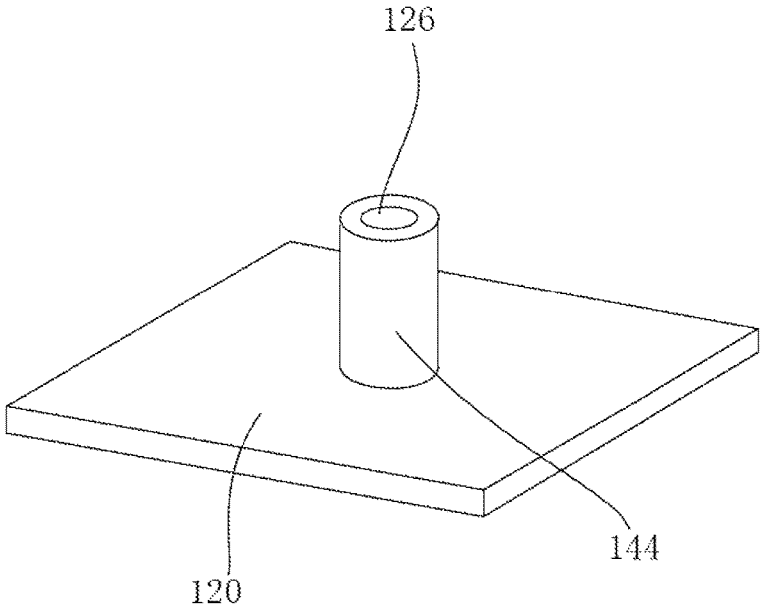
FIG. 15 is a structural diagram of a fastener of an eighth example of the present disclosure.

As shown in FIG. 15, in an eighth example, differences between the eighth and sixth example lie in that, the through pipe 144 is extended from the fastener 120 along the second through hole 126, and is matching to the first through hole 125. The inner side wall of the through pipe 144 is connected to the inner side wall of the second through hole 126, which increases the contact area of the fastener 120 and the leading wire 130, and the inner side walls of the second through hole 126 and the through pipe 144 limit the leading wire 130, thus, the leading wire is firmly fixed. Compared with the limit of only the second through hole 126 to the leading wire, the limits of the second through hole 126 and the through pipe 144 to the leading wire 130 increase the resistance to the leading wire when the leading wire is pulled, thus, the leading wire 130 is firmly fixed at the electric heating pad for the water tank. In addition, the through pipe 144 is matching to the first through hole 125 of the substrate 100, the acting force produced when pulling the leading wire 130 is directly acted on the side wall of the first through hole 125, thereby avoiding damage to the substrate 100.

EXAMPLE 9

Figure 16:
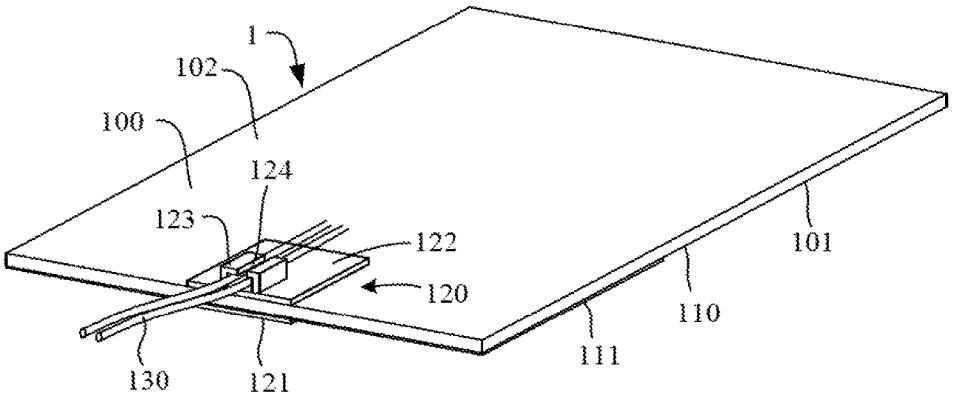
FIG. 16 is a stereogram of an electric heating pad for a water tank of a ninth example of the present disclosure.
Figure 17:
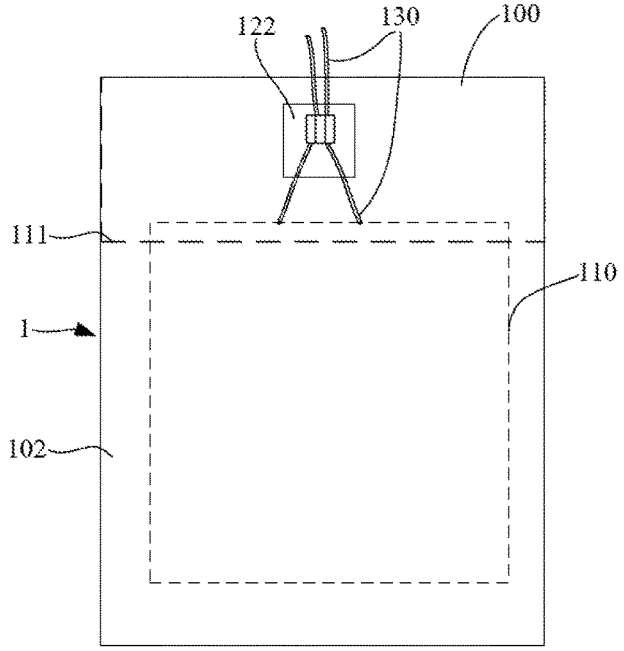
FIG. 17 is a top view of the electric heating pad for the water tank of the ninth example of the present disclosure.
Figure 18:
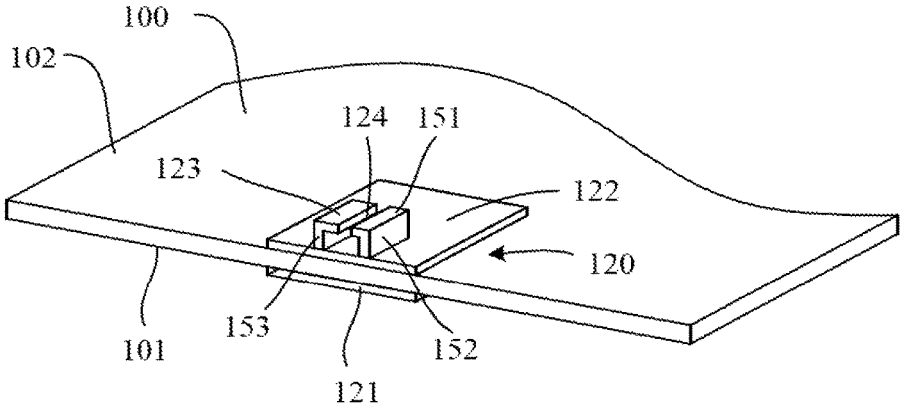
FIG. 18 is a structural diagram of a fastener of the electric heating pad for the water tank of the ninth example of the present disclosure.

An shown in FIG. 16-FIG. 18, in a ninth example of the present disclosure, the electric heating pad 1 for the water tank comprises the substrate 100 comprising the first face 101 and the second face 102, the heating layer 110 paved on the first face 101 of the substrate 100, and the leading wire 130 electrically connected to the heating layer 110.

The electric heating pad 1 for the water tank further comprises the fastener 120 that fixes the leading wire 130. The fastener 120 comprises the first fixed part 121 and the second fixed part 122 that are arranged on the substrate 100, and the clamp part 123 is arranged at the second fixed part 122, where the first fixed part 121 is arranged on the first face 101 of the substrate 100, and the second fixed part 122 is arranged on the second face 102 of the substrate 100. An open-slot 124 is arranged at the clamp part 123, the leading wire 130 is clamped into the clamp part 123 through the open-slot 124, and a width of the open-slot 124 is less than the diameter of the leading wire 130. In the present disclosure, the clamp part 123 is arranged at the electric heating pad for the water tank, the open-slot 124 is arranged at the clamp part 123, where the width of the open-slot 124 is less than the diameter of the leading wire 130, and the leading wire 130 is easily clamped into the clamp part 123 through the open-slot 124, thereby making the leading wire be easily clamped and fixed by the clamp part 123, and avoiding removing of the leading wire 130. Compared with arranging the leading wire in the clamp part 123 through end-ports of the clamp part 123 at two ends thereof arranging the leading wire in the clamp part 123 through the open-slot 124 is easier and faster. The first fixed part 121 and second fixed part 122 are fixed on the substrate 100 of the electric heating pad for the water tank, and the clamp part 123 is fixed on the second fixed part 122, thus, the clamp part 123 is firmly fixed, and the leading wire 130 clamped in the clamp part 123 is firmly fixed, thereby avoiding disconnection between the leading wire 130 and the heating layer 110 when the leading wire 130 is pulled.

As shown in FIG. 18, the clamp part 123 comprises a plurality of side walls. The clamp part 123 comprises a first side wall 151 opposite to the second fixed part 122, a second side wall 152, and a third side wall 153, where the second and third side wall are arranged at each side of the first side wall. In the example, the open-slot 124 is arranged at the first side wall 151 of the clamp part 123, which makes the leading wire 130 be easily clamped into the clamp part 123. Compared with arranging the leading wire in the clamp part 123 through end-ports of the clamp part 123 at two ends thereof, arranging the leading wire in the clamp part 123 through the open-slot 124 is easier and faster, and time of producing the electric heating pad for the water tank is shortened. The leading wire 130 is clamped and fixed by the clamp part 123, which avoids removing of the leading wire 130 from the clamp part 123. It should be understood that the open-slot 124 may be arranged at the second side wall 152 or the third side wall 153.

In the example, the adhesive layer 116 is arranged at the surface of the heating layer 110, and the protecting layer 115 is arranged on the adhesive layer 116, where the protecting layer 115 may be removed when the electric heating pad for the water tank is used. When the electric heating pad for the water tank is used, the protecting layer 115 is removed, and the electric heating pad for the water tank is pasted on the water tank though the adhesive layer 116. The water tank can be heated when power turns on. Thus, the adhesive layer 116 and the protecting layer 115 improve facilitating function of use of the electric heating pad for the water tank. The first and second fixed parts may are fixed on the substrate 100 through binding, and the first and second fixed part may also be fixed on the substrate 100 through other methods, e.g. the connecting rod and hot melt. The connecting rod may connect the first fixed part 121 to the second fixed part 122.

When the electric heating pad for the water tank is used, the acting force produced during pulling the leading wire 130 is acted on the clamp part 123 fixed on the second fixed part 122. The first and second fixed parts may be fixed on the substrate 100 through binding, sizes of the first and second fixed parts are corresponding, and are greater than size of the clamp part 123, thus, the acting force produced during pulling the leading wire 130 is acted on the first and second fixed parts, thereby avoiding to ear the heating layer. In order to further avoid to tear the heating layer 110, the reinforcing material layer 111 is arranged at one of faces of the substrate 100 of the electric heating pad for the water tank, where the first fixed part 121 is fixed on the face of the substrate 100 having the reinforcing material layer 111, and is arranged to cling the reinforcing material layer 111. The reinforcing material layer 111 is arranged between the first fixed part 121 and the substrate 100, which enhances strength and tensile property of the first fixed part 121. The first fixed part 121 and the second fixed part 122 are arranged thee to face, and the clamp part 123 is arranged on the second fixed part 122, which enhances strength and tensile property of the clamp part 123, thus, the leading wire 130 is firmly fixed, and stable connection between the leading wire 130 and the heating layer 110 is ensured. It should be understood that the reinforcing material layer may be arranged between the second fixed part and the substrate, or the reinforcing material layer is arranged the first and second faces of the substrate, thus, strength and tensile property of the fixed part is improved, and the leading wire is firmly fixed.

In the example, area of the reinforcing material layer 111 is greater than contact area of the first fixed part 121 and the reinforcing material layer 111, which enhances tensile property of the heating layer 110.

EXAMPLE 10

Figure 19:
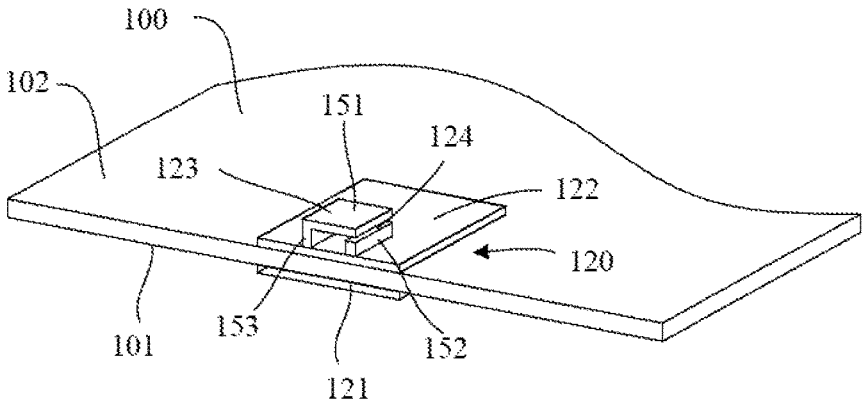
FIG. 19 is a structural diagram of a fastener of an electric heating pad for a water tank of a tenth example of the present disclosure.

As shown in FIG. 19, in a tenth example of the present disclosure, differences between the tenth and ninth example lie in that, the open-slot 124 is arranged at the second side wall 152 of the clamp part 123, which makes the leading wire 130 be easily clamped into the clamp part 123. Compared with arranging the leading wire in the clamp part 123 through end-ports of the clamp part 123 at two ends thereof, arranging the leading wire in the clamp part 123 through the open-slot 124 is easier and faster, and time of producing the electric heating pad for the water tank is shortened. The leading wire 130 is clamped and fixed by the clamp part 123, which avoids removing of the leading wire 130 from the clamp part 123. It should be understood that the open-slot may also be arranged at other position, e.g. the third side wall 153.

EXAMPLE 11

Figure 20:
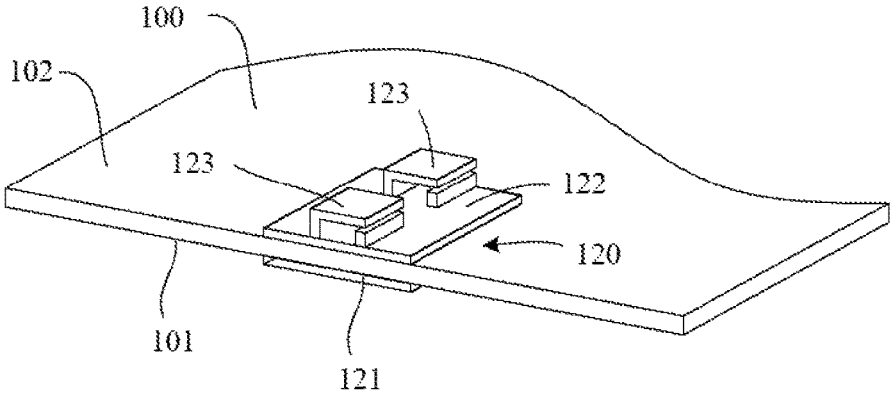
FIG. 20 is a structural diagram of a fastener of an electric heating pad for a water tank of an eleventh example of the present disclosure.

As shown in FIG. 20, in an eleventh example, difference between the ninth and eleventh example lie that, the second fixed part 122 is configured with two clamp parts 123 that extend along the leading, wire 130. The leading wire 130 is clamped and fixed by the two clamp parts 123 together, which increases the fixed area of the leading wire 130, and makes the leading wire 130 be firmly fixed. It should be understood that, in the example, the number of the clamp part may be three, four, or other. The leading wire is clamped and fixed by the plurality of clamp parts together, which increases the fixed area of the leading wire, and makes the leading wire be firmly fixed. The example is improved according to the first example, namely the open-slot is arranged at the second side wall. It should be understood that, the example may also be improved according to the second example, namely two or the plurality of clamp parts are arranged, and the open-slot is arranged at the first side wall.

EXAMPLE 12

Figure 21:
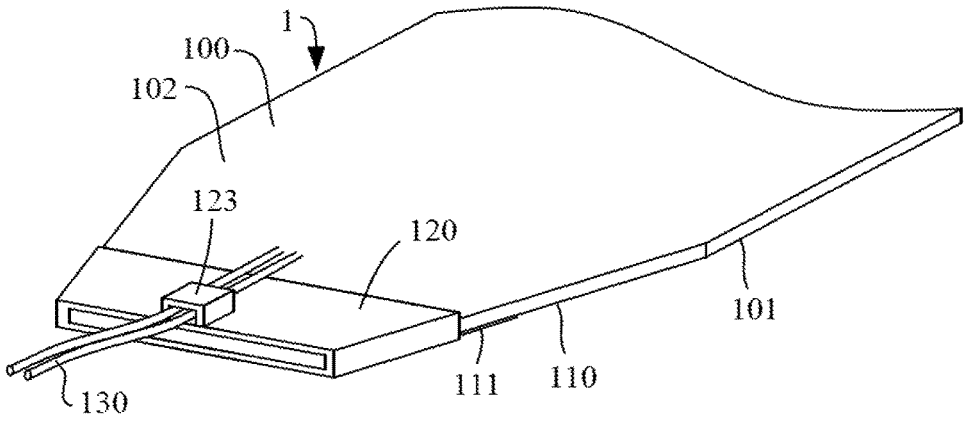
FIG. 21 is a stereogram of an electric heating pad for a water tank of a twelfth example of the present disclosure.
Figure 22:
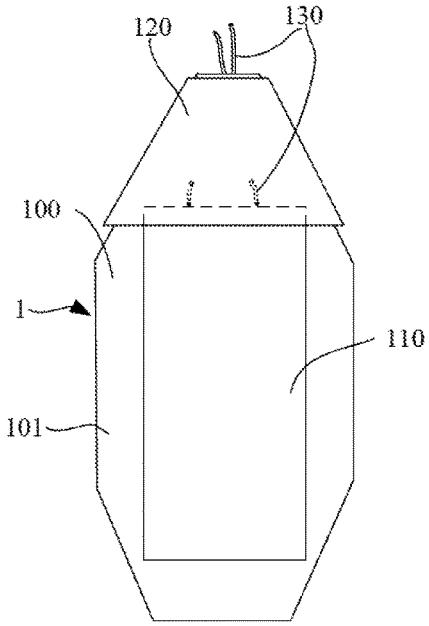
FIG. 22 is a top view of the electric heating pad for the water tank of the twelfth example of the present disclosure.

An shown in FIG. 21 and FIG. 22, in a twelfth example of the present disclosure, the electric heating pad 1 for the water tank comprises the substrate 100 comprising the first thee 101 and the second face 102, the heating layer 110 paved on the first face 101 of the substrate 100, and the leading wire 130 electrically connected to the heating layer 110.

The electric heating pad for the water tank further comprises the fastener 120 sleeved and fixed on the substrate 100, and the clamp part 123 is arranged at the fastener 120, where the leading wire 130 is clamped and fixed by the clamp part 123. In the present disclosure, the leading wire 130 is fixed in the clamp part 123 of the fastener 120, and the fastener 120 is sleeved and fixed on the substrate 100, thus, the leading wire 130 is firmly fixed on the electric heating pad for the water tank. The acting force produced during pulling the leading wire is acted on the fastener 120, which avoids disconnection between the leading wire 130 and the heating layer 110. The fastener 120 is sleeved and fixed on the substrate, and the fixed area of the fastener is increased, which avoids damage to the electric heating pad for the water tank when the leading wire is pulled.

In the example, the fastener 120 is made of metal material, and the metal material has great strength and may be firmly fixed. It should be understood that the fastener 120 may also be made of other materials, e.g. plastic material, where the plastic material has good elasticity and tensile property.

In the example, two ends of the substrate 100 taper to form conical contour, the fastener 120 is matching to the end portion of the substrate to taper, which makes the fasteners be firmly fixed on the substrate 100. It should be understood that the end portion of the substrate may also be other shapes.

When the electric heating pad is used, the acting force produced during pulling the leading wire 130 is acted on the clamp part 123 fixed on the fastener 120, thus, the acting force further acts on the fastener 120. The fastener 120 is firmly sleeved and fixed on the substrate 100, thereby avoiding tearing the electric heating pad for the water tank. In order to further avoid tearing the electric heating pad for the water tank, the reinforcing material layer 111 is arranged at one of faces of the substrate 100 of the electric heating pad for the water tank, and the fastener 120 is arranged to cling the reinforcing material layer 111. The reinforcing material layer 111 enhances the strength and tensile property of the fastener 120, thus, the leading wire 130 is firmly fixed, and stable connection between the leading wire 130 and the heating layer 110 is ensured. It should be understood that the reinforcing material layer may be arranged at the two faces of the substrate, thus, the strength and tensile property of the fastener are further improved, and the leading wire is firmly fixed.

In the example, the area of the reinforcing material layer 111 is greater than contact area of the fastener 120 and the reinforcing material layer 111, which enhances the tensile property of the heating layer 110.

In the example, the electric heating pad for the water tank may be used for a easing pipe for the water tank of the car to avoid icing formation of the casing pipe for the water tank in winter.

EXAMPLE 13

Figure 23:
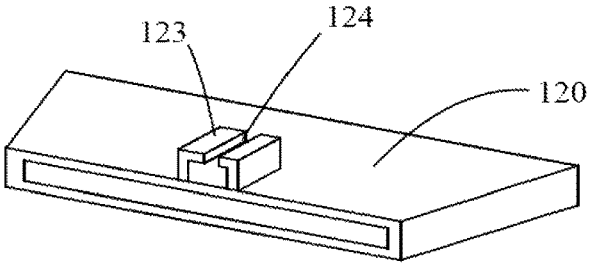
FIG. 23 is a structural diagram of a fastener of an electric heating pad for a water tank of a thirteenth example of the present disclosure.

As shown in FIG. 23, in a thirteenth example of the present disclosure, differences between the thirteenth and twelfth example lie in that, the open-slot 124 is arranged at the first side wall of the clamp part 123, and the width of the open-slot 124 is less than the diameter of the leading wire, thus, the leading wire be easily clamped into the clamp part 123 through the open-slot 124. Compared with arranging the leading wire in the clamp part 123 through end-ports of the clamp part 123 at two ends thereof, arranging the leading wire in the clamp part 123 through the open-slot 124 is easier and faster, and time of producing the electric heating pad for the water tank is shortened. The leading wire is clamped and fixed by the clamp part 123, which avoids removing of the leading wire from the clamp part 121. It should be understood that, in the example, the open-slot may be arranged at other side walls of the clamp part.

EXAMPLE 14

Figure 24:
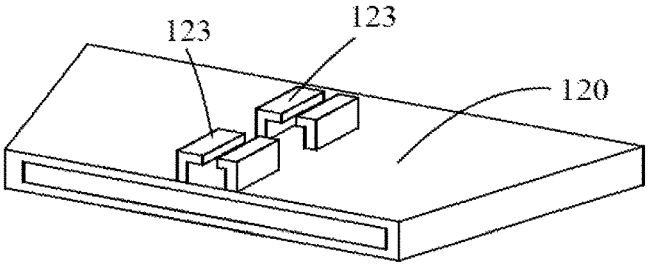
FIG. 24 is a structural diagram of a fastener of an electric heating pad for a water tank of a fourteenth example of the present disclosure.

As shown in FIG. 24, in a fourteenth example, differences between the fourteenth and twelfth example lie that, the fastener 120 is configured with two clamp parts 123 that extend along the leading wire. The leading wire is clamped and fixed by the two clamp parts 123 together, which increases the fixed area of the leading wire, and makes the leading wire be firmly fixed. It should be understood that, in the example, the number of the clamp part may be three, four, or other. The leading wire is clamped and fixed by the plurality of clamp parts together, which increases the fixed area of the leading wire, and makes the leading wire be firmly fixed.

EXAMPLE 15

Figure 25:
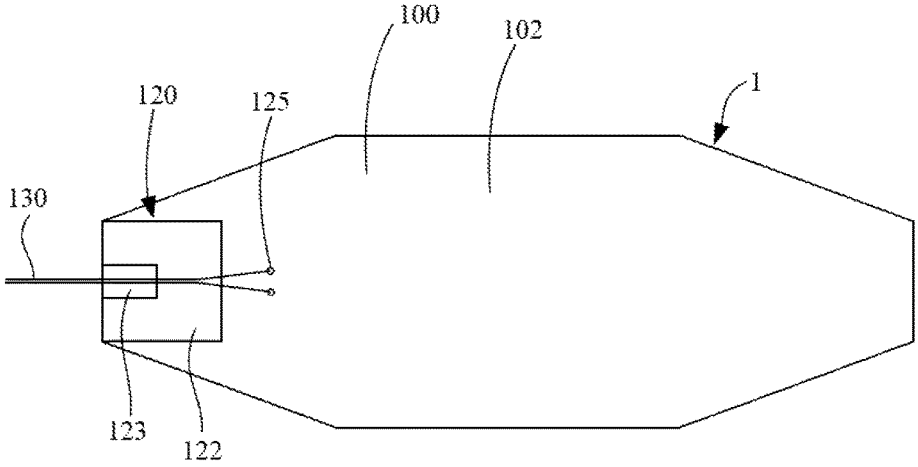
FIG. 25 is a top view of a second face of a substrate of a fifteenth example of the present disclosure.
Figure 26:
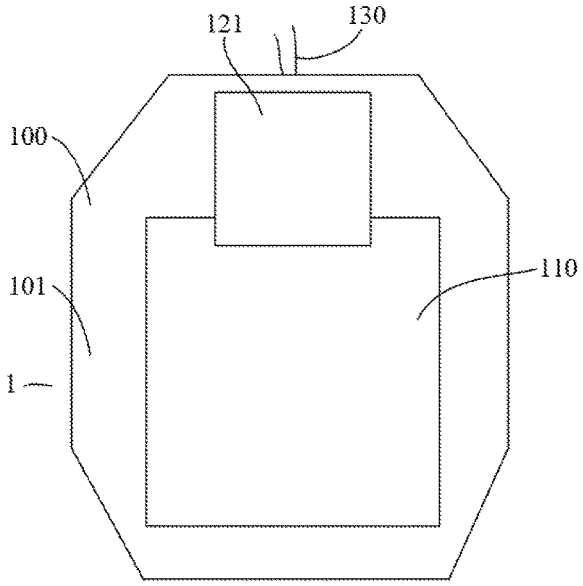
FIG. 26 is a top view of a first face of the substrate of the fifteenth example of the present disclosure.
Figure 27:
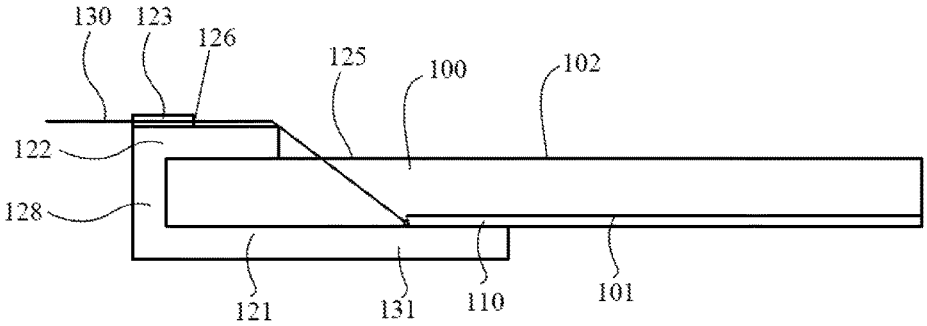
FIG. 27 is a structural diagram of the electric heating pad for the water tank of the fifteenth example of the present disclosure.

An shown in FIG. 25-FIG. 27, in a fifteenth example of the present disclosure, the electric heating pad 1 for the water tank comprises the substrate 100 comprising the first face 101 and the second face 102, the heating layer 110 paved on the first face 101 of the substrate 100, and the leading wire 130, where the leading wire 130 is electrically connected to the heating layer 110 to form the connection point 131, the substrate 100 is configured with the first through hole 125 matching to the leading wire 130, and the leading wire 130 passes through the second face 102 of the substrate 100.

The electric heating pad 1 for the water tank further comprises the fastener 120, and the fastener 120 comprises the first fixed part 121 arranged on the first face 101 of the substrate 100 and the second fixed part 122 arranged on the second face 102 of the substrate 100. The first fixed part 121 is in direct contact with the connection point 131, and the connection point 131 is fully covered by the first fixed part 121. The first fixed part 121 is in fixed connection with the second fixed part 122. The clamp part 123 is arranged at the second fixed part 122, the second through hole 126 is arranged at the clamp part 123, and the second through hole 126 is matching to the leading wire 130. The fastener 120 further comprises the connecting rod 128, where the connecting rod 128 connects the first fixed part 121 to the second fixed part 122.

A clamp force is produced by the first fixed part 121 to the leading wire 130 from the substrate 100. The connecting rod 128 connects the first fixed part 121 to the second fixed part 122, which makes the substrate 100 be clamped between the first fixed part 121 and the second fixed part 122, and the clamp force is formed. When the leading wire 130 is pulled, the clamp force shares part of the acting force acted on the heating layer 110 from the leading wire 130, which avoids damaging to the electric heating pad for the water tank. The connection point 131 is fully covered by the first fixed part 121, and the first fixed part 121 is in direct contact with the connection point 131, which makes the connection point 131 not to be exposed, thus, current leakage is avoided for the electric heating pad for the water tank, free conduction is ensured, and use of the electric heating pad for the water tank is safe. In addition, manufacturing method is simple, the connection point 131 between the leading wire 130 and the heating layer 110 is fixed without the reinforcing material layer fixing, thereby reducing the material and manufacturing process, saving manufacturing costs, and improving corporate profits.

The substrate 100 comprises a foam layer, an up-fiber layer, a down-fiber layer, a gum, and an oiled paper are pasted in sequence, where the heating layer 110 is arranged between the up-fiber layer and the down-fiber layer. The first fixed part 121 is made of insulative material to protect the connection point 131. The connection point between the heating layer and the leading wire is fully covered by the first fixed part 121, which effectively protect the electric heating pad for the water tank.

EXAMPLE 16

Figure 28:
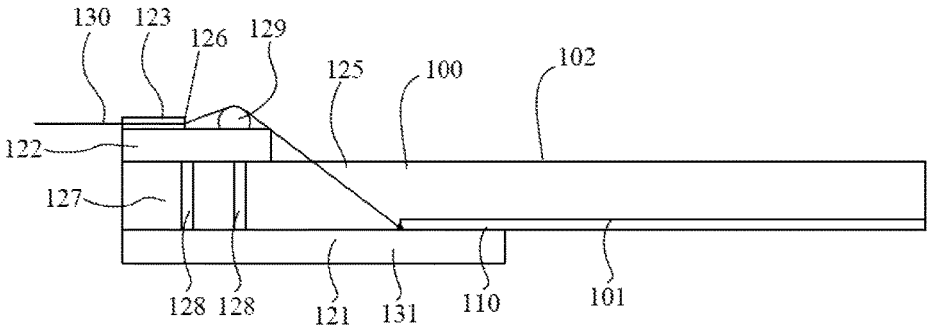
FIG. 28 is a structural diagram of an electric heating pad for a water tank of a sixteenth example of the present disclosure.

As shown in FIG. 28, in a sixteenth example, differences between the fifteenth and sixteenth examples lie in that, a third through hole 127 is arranged at the substrate 100, and the connecting rod 128 passes through the third through hole 127 to clamp the substrate 100 between the first fixed part 121 and the second fixed part 122, which makes the connecting rod 128 be hided in the substrate 100, thus, outer structure of the electric heating pad for the water tank is simple.

In the example, a protruding portion 129 is arranged on the second fixed part 122. The protruding portion 129 is arranged between the first through hole 126 and the clamp part 123, and height of the protruding portion 129 is greater than height of the clamp part 123. The leading wire 130 from the second face 102 of the substrate 100 goes along a top portion of the protruding portion 129, and passes through the clamp part 123 via the second through hole 126. In the example, when the leading wire 130 is pulled, acting point is acted on the clamp part 123 because an angle exists before the leading wire passes through the second through hole 126, thus, the acting force produced during pain, the leading wire is not directly acted on the connection point 131 between the leading wire 130 and the heating layer 110, and the service life of the electric heating pad for the water tank is prolonged. The top portion of the protruding portion 129 is a circle-arc bump, thus, the leading wire is not overcut when the leading wire rubs the protruding portion. The leading wire is limited by the clamp part, which ensures the leading wire protected when the leading wire from different directions is pulled, thus, the electric heating pad for the water tank of the present disclosure is not easy to be damaged.

EXAMPLE 17

Figure 29:
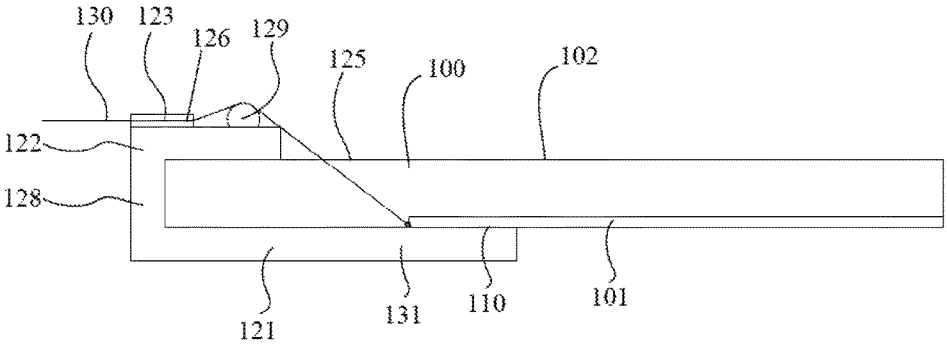
FIG. 29 is a structural diagram of an electric heating pad for a water tank of a seventeenth example of the present disclosure.

As shown in FIG. 29, in a seventeenth example, differences between the seventeenth and the fifteenth example lie in that, the first fixed part 121, the second fixed part 122, and the connecting rod 128 are integrally formed in a single piece, which makes the fastener be easier produced, and installation of the fastener is simple and high efficiency.

In the example, the protruding portion 129 is arranged on the second fixed part 122. The protruding portion 129 is arranged between the first through hole 126 and the clamp part 123, and height of the protruding portion 129 is greater than height of the clamp part 123. The leading wire 130 from the second face 102 of the substrate 100 goes along the top portion of the protruding portion 129, and passes through the clamp part 123 via the second through hole 126. In the example, when the leading wire 130 is pulled, the acting point is acted on the clamp part 123 because the angle exists before the leading wire passes through the second through hole 126, thus, the acting force produced during pulling the leading wire is not directly acted on the connection point 131 between the leading wire 130 and the heating layer 110, and the service life of the electric heating pad for the water tank is prolonged. The top portion of the protruding portion 129 is the circle-arc bump, thus, the leading wire is not overcut when the leading wire rubs the protruding portion. The leading wire is limited by the clamp part, which ensures the leading wire protected when the leading wire is pulled from different directions, thus, the electric heating pad for the water tank of the present disclosure is not easy to be damaged.

EXAMPLE 18

Figure 30:
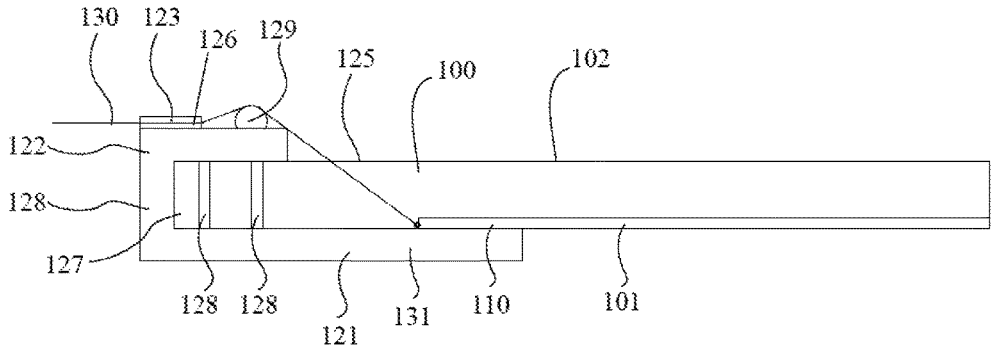
FIG. 30 is a structural diagram of an electric heating pad for a water tank of an eighteenth example of the present disclosure.

As shown in FIG. 30, in an eighteenth example, differences between the fifteenth and eighteenth examples lie in that, the third through hole 127 is arranged at the substrate 100, and the connecting rod 128 passes through the third through hole 127 to clamp the substrate 100 between the first fixed part 121 and the second fixed part 122. The first fixed part 121, the second fixed part 122, and the connecting rod 128 are integrally formed in a single piece, which makes the fastener be firmly fixed on the substrate.

In the example, the protruding portion 129 is arranged on the second fixed part 122. The protruding portion 129 is arranged between the first through hole 126 and the clamp part 123, and height of the protruding portion 129 is greater than height of the clamp part 123. The leading wire 130 from the second face 102 of the substrate 100 goes along the top portion of the protruding portion 129, and passes through the clamp part 123 via the second through hole 126. In the example, when the leading wire 130 is pulled, the acting point is acted on the clamp part 123 because the angle exists before the leading wire passes through the second through hole 126, thus, the acting force produced during pulling the leading wire is not directly acted on the connection point 131 between the leading wire 130 and the heating layer 110, and the service life of the electric heating pad for the water tank is prolonged. The top portion of the protruding portion 129 is the circle-arc bump, thus, the leading wire is not overcut when the leading wire rubs the protruding portion. The leading wire is limited by the clamp part, which ensures the leading wire protected when the leading wire is pulled from different directions, thus, the electric heating pad for the water tank of the present disclosure is not easy to be damaged.

EXAMPLE 19

Figure 31:
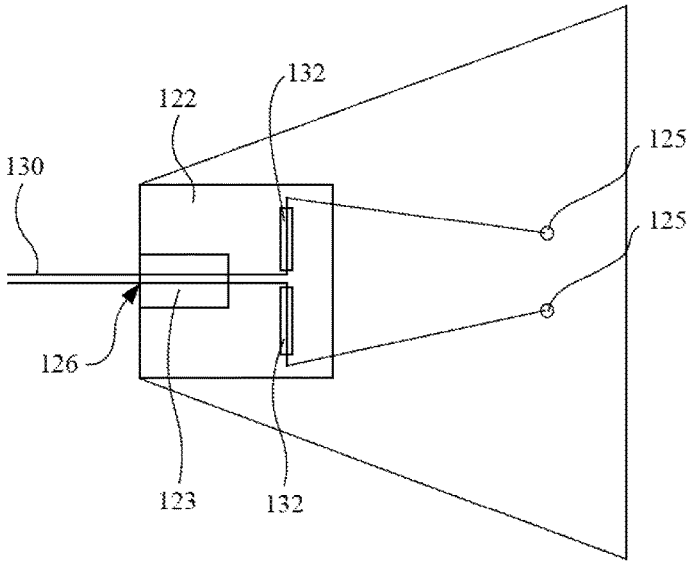
FIG. 31 is a structural diagram of an electric heating pad for a water tank of a nineteenth example of the present disclosure.

As shown in FIG. 31 and FIG. 32, in a nineteenth example, differences between the nineteenth and the fifteenth examples lie in that, a clamping slot 132 is arranged at the second fixed part 122, and the clamping slot 132 is arranged between the first through hole 125 and the clamp part 123. An extending direction of the clamping slot 132 and an extending direction of the second through hole 126 cross each other. The leading wire 130 is inserted into the clamping slot 132, and passes through the clamp part 123 via the second through hole 126. It should be understood that, in the example, the extending direction of the second through hole 126 is perpendicular to the extending direction of the clamping slot 132, and other angles is also ok. Stressed points of the leading wire are dispersed after the leading wire is bent many times, the acting force produced during pulling the leading wire 130 is not directly acted on the connection point, between the leading wire 130 and the heating layer, thus, the electric heating pad for the water tank is not damaged.

EXAMPLE 20

Figure 35:
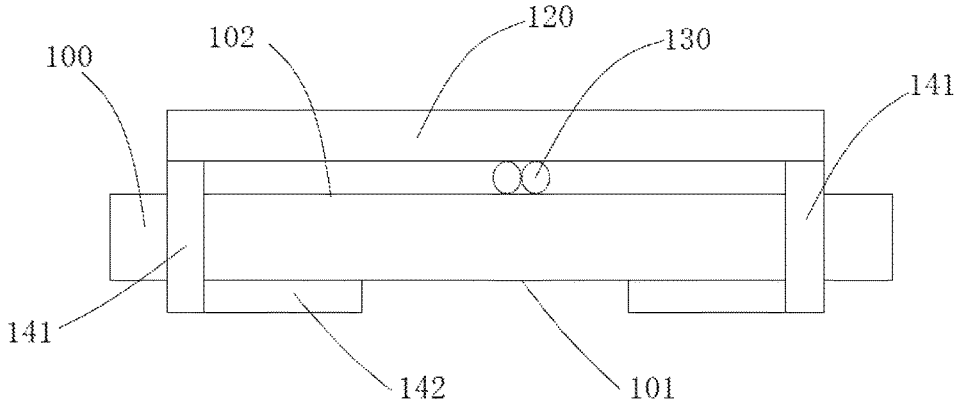
FIG. 35 is a sectional view of the electric heating pad for the water tank of the twentieth example of the present disclosure.

As shown in FIG. 33-FIG. 35, in a twentieth example of the present disclosure, the electric heating pad 1 for the water tank comprises the substrate 100 comprising the first face 101 and the second face 102, the heating layer 110 paved on the first face 101 of the substrate 100, and the leading wire 130, where the leading wire 130 is electrically connected to the heating layer 110, and the leading wire 130 passes through the second face 102 of the substrate 100.

The electric heating pad 1 for the water tank further comprises the fastener 120 arranged at the second face 102 of the substrate 100. Fixed pins 141 are connected to two ends of the fastener 120, and the leading wire 130 exposed to the second face 102 of the substrate passes between the fastener 120 and the second face 102 of the substrate 100. The fastener 120 is connected to a first end of the fixed pin 141, and a second end of the fixed pin 141 passes through the substrate 100 and be tightened with the first face 101 of the substrate 100.

In the present disclosure, the leading wire 130 is clamped and positioned by the fastener 120 and the second face 102 of the substrate 100, when the leading wire 130 is pulled, most of pulling force are acted on the fastener 120, which reduces the acting force to the connection point between the leading wire 130 and the heating layer 110, and the connection point is not easy to fall off, thereby improving the service life of the electric heating pad for the water tank. In addition, the fixed pins are connected to two ends of the fastener 120, stress of the fastener 120 is evenly distributed to the fixed pins 141, and the fastener 120 does not fall off even if the pulling force is great, which further improves the service life of the electric heating pad for the water tank. As long as length of the fixed pin 141 is greater than thickness of the substrate 100, the fixed pin 141 is tightened with the substrate 100, and the fastener is firmly fixed, thus, the fixed pin 141 having enough length may be used for different thicknesses of electric heating pad for the water tank, and generality the fixed pin is good, thereby reducing production costs.

The heating layer 110 comprises two heat-conducting layers 112 that are made of insulative material, and a carbon fiber layer 113 is arranged between the two heat-conducting layers 112. The carbon fiber layer 113 comprises a plurality of carbon fiber filaments, two adjacent carbon fiber filaments are parallel to each other, and each of the carbon fiber filaments is arranged in a curve, which increases coverage area of the carbon fiber filament, and heating is uniform.

A bending portion 142 is formed at the second end of the fixed pin 14, and the bending portion 142 and the first face 101 of the substrate 100 are fixed by bonding. Distance between the fixed pins arranged two ends of the fastener 120 is same as a width of the fastener 120, and the fastener 120 and the fixed pin 141 are integrally form in a single piece. In order to further improve resistance to stress of the fastener, one end of the fastener 120 may be configured with two or more fixed pins 141.

Area of the heating layer 110 is less than or equal to 97% area of the substrate 100. The area of the heating layer should be increased in order to improve efficiency of usage of the electric heating pad for the water tank, if the area of the heating layer is too large, the leading wire cannot be positioned on the substrate, and the connection point between the leading wire and the heating layer is easy to fall off when the leading wire is pulled. It should be considered that, the area of the heating layer is less than or equal to 97% the area of the substrate, which ensures the leading wire to be firmly positioned. Preferably 97%, 95%, 90%, 85% ,80%, 75%, 70%, 68%, 65%. 60%.

In the example, as long as the length of the fixed pin 141 is greater than the thickness of the substrate 100, length of the bending portion 142 may be adjusted according to thickness of the substrate 100, structure is simple, cost is low, and generality is good.

EXAMPLE 21

Figure 36:
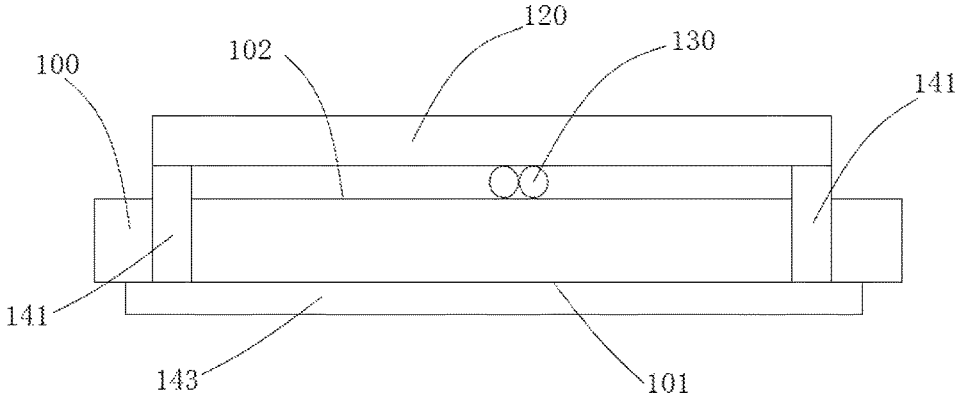
FIG. 36 is a sectional view of an electric heating pad for a water tank of a twenty-first example of the present disclosure.

In a twenty-first example, another method for fixing the fixed pin to the substrate is shown. As shown in FIG. 36, a reinforced sheet made of hard material is fixed on the first face 101 of the substrate 100, and the second end of the fixed pin 141 is in fixed connection with the reinforced sheet 143. Contact area of the reinforced sheet 143 and the substrate 100 is great, and the fixed pin 141 is in fixed connection with the reinforced sheet 143, which improves connection strength of the fastener 120 and the substrate 100. The fastener 120 and the fixed pin 141 are integrally formed in a single piece.

One end of the fastener may be configured with two or more fixed pins 141, which improves resistance to stress of the fastener 120.

The area of the heating layer 110 is less than or equal to 97% area of the substrate 100. The area of the heating layer should be increased in order to improve efficiency of usage of the electric heating pad for the water tank, if the area of the heating layer is too large, the leading wire cannot be positioned on the substrate, and the connection point between the leading wire and the heating layer is easy to fall off when the leading wire is pulled. It should be considered that, the area of the heating layer is less than or equal to 97% the area of the substrate, which ensures the leading wire to be firmly positioned. Preferably 97%, 95%, 90%, 85%, 80%, 75%, 70%, 68%, 65%, 60%.

In the example, the contact area of the reinforced sheet 143 and the substrate 100 is great, and the fixed pin 141 is in fixed connection with the reinforced sheet 143, which improves connection strength of the fastener 120 and the substrate 100.

The present disclosure is described in detail in accordance with the above contents with the specific exemplary examples. However, this present disclosure is not limited to the specific examples. For the ordinary technical personnel of the technical field of the present disclosure, on the premise of keeping the conception of the technical personnel can also make simple deductions or replacements, and all of which should be considered to belong to the protection scope of the present disclosure.

I claim:

1. An electric heating pad for a water tank, comprising:
a substrate;
a heating layer payed on the substrate;
a leading wire that is electrically connected to the heating layer;
a reinforcing material layer fixed on the substrate; and
a fastener fixed between the substrate and the reinforcing material layer;
wherein a first through hole is defined in the substrate, a second through hole is aligned to the first through hole and defined in the fastener, and the leading wire passes through the first through hole and the second through hole.

2. The electric heating pad for the water tank of claim 1, wherein a through pipe is extended from the fastener along a direction of a side wall of the second through hole toward the substrate, the leading wire passes through the through pipe, and the through pipe is matching to the first through hole.

3. The electric heating pad for the water tank of claim 2, wherein a height of the through pipe is less than or equal to a height of the first through hole.

4. The electric heating pad for the water tank of claim 1, wherein two second through holes are defined in the fastener corresponding to two leading wires, respectively.

5. The electric heating pad for the water tank of claim 1, wherein the fastener is made of plastic material or metal material.

6. The electric heating pad for the water tank of claim 1, wherein a groove is arranged at the fastener, and the leading wire is fixed in the groove; the groove is connected to the second through hole; a placing slot is arranged between the substrate and the reinforcing material layer, and the fastener is arranged in the placing slot.

* * * * *